US008191318B2

(12) United States Patent
Kitagawa

(10) Patent No.: US 8,191,318 B2
(45) Date of Patent: Jun. 5, 2012

(54) PREFABRICATED RESIN HOUSE

(75) Inventor: Katsuyuki Kitagawa, Kaga (JP)

(73) Assignee: Yugenkaisha Japan Tsusyo, Ishikawa (JP)

( * ) Notice: Subject to any disclaimer, the term of this patent is extended or adjusted under 35 U.S.C. 154(b) by 0 days.

(21) Appl. No.: 13/064,149

(22) Filed: Mar. 8, 2011

(65) Prior Publication Data

US 2011/0219707 A1 Sep. 15, 2011

Related U.S. Application Data

(63) Continuation of application No. 10/519,808, filed as application No. PCT/JP03/08646 on Jul. 8, 2003, now abandoned.

(30) Foreign Application Priority Data

Jul. 8, 2002 (JP) ..... 2002-198358

(51) Int. Cl.
*E04B 7/00* (2006.01)

(52) U.S. Cl. ..... 52/82; 52/79.4; 52/80.1; 52/81.1; 52/81.4

(58) Field of Classification Search ..... 52/79.4, 52/80.1, 81.1, 82, 86, 282.1, 284, 292, 293.1, 52/294, 295, 309.1, 80.2, 81.4, 90.1, 270, 52/602, 633.1, 644; 12/16
See application file for complete search history.

(56) References Cited

U.S. PATENT DOCUMENTS

| | | | | |
|---|---|---|---|---|
| 465,900 | A * | 12/1891 | Walker | 52/169.6 |
| 775,562 | A * | 11/1904 | Gollien | 52/602 |
| 2,958,918 | A * | 11/1960 | MacMillan | 264/220 |
| 3,295,267 | A * | 1/1967 | Lundell | 52/222 |
| 3,605,353 | A * | 9/1971 | Marcott | 52/91.3 |
| 3,797,190 | A * | 3/1974 | Widdowson | 52/592.4 |
| 4,663,898 | A | 5/1987 | Yacaboni | |
| 4,774,794 | A * | 10/1988 | Grieb | 52/309.7 |
| 4,788,803 | A | 12/1988 | Seitz | |
| 4,967,528 | A | 11/1990 | Doran | |
| 5,046,789 | A * | 9/1991 | Lee | 312/108 |
| 5,050,354 | A | 9/1991 | Vendramini | |
| 5,319,904 | A | 6/1994 | Pascoe | |
| 5,341,610 | A | 8/1994 | Moss | |
| 5,522,186 | A * | 6/1996 | Jarman | 52/73 |
| 5,675,941 | A | 10/1997 | Dykmans | |
| 5,724,775 | A | 3/1998 | Zobel, Jr. et al. | |

(Continued)

FOREIGN PATENT DOCUMENTS

JP U 55-47583 9/1953

(Continued)

OTHER PUBLICATIONS

Nov. 4, 2011 Notification of Reasons for Refusal for JP Patent Appln. No. 2009-244639 w/translation.

*Primary Examiner* — Brian Glessner
*Assistant Examiner* — James Buckle, Jr.
(74) *Attorney, Agent, or Firm* — Oliff & Berridge, PLC

(57) ABSTRACT

A prefabricated resin house includes a peripheral wall 10 achieved by assembling a plurality of peripheral wall structural members 11-19 constituted of resin and a roof 30 that is formed by assembling a plurality of roof structural members 31-39 constituted of resin and is placed on top of the peripheral wall 10.

6 Claims, 37 Drawing Sheets

U.S. PATENT DOCUMENTS

| | | | | |
|---|---|---|---|---|
| 5,842,315 | A * | 12/1998 | Lin | 52/309.9 |
| 6,006,480 | A | 12/1999 | Rook | |
| 6,085,485 | A * | 7/2000 | Murdock | 52/783.19 |
| 6,247,281 | B1 * | 6/2001 | Lin | 52/309.4 |
| 2007/0261319 | A1 | 11/2007 | Fitzpatrick | |

FOREIGN PATENT DOCUMENTS

| | | | |
|---|---|---|---|
| JP | Y1 48-11217 | | 3/1973 |
| JP | S-49-040970 | | 11/1974 |
| JP | Y-51-20091 | | 5/1976 |
| JP | U-57-54510 | | 9/1980 |
| JP | U 59-107675 | | 7/1984 |
| JP | U-61-1504 | | 1/1986 |
| JP | 63-254384 | A | 10/1988 |
| JP | A-2-190541 | | 7/1990 |
| JP | U 6-8622 | | 2/1994 |
| JP | Y2-06-040724 | | 10/1994 |
| JP | Y2-06-040787 | | 10/1994 |
| JP | 7-3891 | A | 1/1995 |
| JP | 3012866 | U | 6/1995 |
| JP | A 7-166719 | | 6/1995 |
| JP | A 9-170341 | | 6/1997 |
| JP | A 9-177339 | | 7/1997 |
| JP | A-11-141183 | | 5/1999 |
| JP | A-2000-179045 | | 6/2000 |
| JP | A-2001-12195 | | 1/2001 |
| JP | A-2005-315025 | | 11/2005 |
| WO | WO 01/44593 | A1 | 6/2001 |
| WO | WO 2004/005633 | A1 | 1/2004 |

* cited by examiner (a)

(b)

(a)

(b)

(a)

(b)

(a)

(b)

(c)

(a)

(b)

(a)

(b)

PREFABRICATED RESIN HOUSE

This is a Continuation of application Ser. No. 10/519,808 filed Dec. 29, 2004, which is a National Phase of PCT/JP2003/008646 filed Jul. 8, 2003. The disclosures of the prior applications are hereby incorporated by reference herein in their entirety.

TECHNICAL FIELD

The present invention relates to a prefabricated resin house having a living space formed therein by assembling a plurality of structural members constituted of a resin such as styrene foam or fiber reinforced plastic (FRP).

BACKGROUND ART

Outdoor-type accommodation facilities known in the related art include wooden bungalows (cottages or huts). The cost of building a wooden bungalow is high and it requires several days to complete the construction work. While there are tent-type accommodation facilities, their durability is poor and they are not attractive, which limits their installation locations.

Keeping in mind the shortcomings of the background art discussed above, the inventor of the present invention and the like proposed a prefabricated dome in International Publication No. WO 01-44593. This prefabricated dome forms therein a semi-spherical space achieved by assembling a plurality of dome pieces constituted of styrene foam. The prefabricated dome, which can be constructed quickly at low cost, can be used as an outdoor accommodation facility, a residential building or the like.

The dome pieces disclosed in International Publication No. WO01/44593 have a shape achieved by dividing a semi-sphere from the zenith along meridians into 10 equal pieces. The size of the dome pieces is determined in conformance to the diameter of the floor portion of a living space and the height to the zenith. Thus, the individual dome pieces tend to be extremely large, and the transportability of such structural members is an issue yet to be adequately addressed.

DISCLOSURE OF THE INVENTION

The present invention provides a prefabricated resin house that can be achieved by using more compact structural members.

The prefabricated resin house according to the present invention includes a peripheral wall achieved by assembling a plurality of peripheral wall structural members constituted of resin and a roof that is formed by assembling a plurality of roof structural members constituted of resin and is placed on top of the peripheral wall.

Compared to the size of dome pieces assembled to achieve the dome structure in the related art, each ranging continuously from the floor surface to the ceiling, the size (maximum length) of each structural member can be reduced and, as a result, the transportability is improved.

It is desirable to constitute the peripheral wall structural members and the roof structural members with styrene foam. The roof may include an eave projecting out over the external circumference and an interlocking portion on the inner side of the eave and an interlocking portion at the upper end of the peripheral wall may be connected and bonded to each other. Interlocking portions may be formed at the end surfaces on the two sides of each peripheral wall structural member and each roof structural member so as to interlock and bond them at the interlocking portions. A house may be erected by assembling the peripheral wall with the, assembling the roof with the roof structural members and then placing the assembled roof on top of the peripheral wall.

The peripheral wall may assume a substantially cylindrical shape or a substantially rectangular parallelepiped shape. It is desirable to adopt a ribbed structure in the connecting areas where the peripheral wall structural members connect with each other and in the connecting areas where the roof structural members connect with each other.

A frame of the prefabricated house may be formed by assembling steel frame members, and the peripheral wall structural members and the roof structural members may be individually mounted from the outside of the frame. In such a case, it is desirable to use steel frame members constituted of a C-type steel and having a substantially U-shaped section.

Alternatively, the house may include a plurality of strengthening members extending from the zenith of the dome toward the foundation in an arch along meridians, which are disposed over predetermined intervals along the circumference, and a resin outer wall constituted with a plurality of structural members separated from one another along meridians, which are stacked from the foundation toward the zenith of the dome between each pair of strengthening members, so as to assure a sufficient level of structural strength.

It is desirable to form the resin outer wall by bonding structural members constituted of styrene foam. The outer wall may be formed by forming interlocking portions at the end surfaces of each structural member on the two sides and interlocking the structural members at the interlocking portions facing opposite each other. Interlocking portions may be formed at the bottom surfaces of the peripheral wall structural members and these interlocking portions may be interlocked with positioning members fixed in advance under the peripheral wall structural members.

BEST MODE FOR CARRYING OUT THE INVENTION

-First Embodiment-

Figure 1:
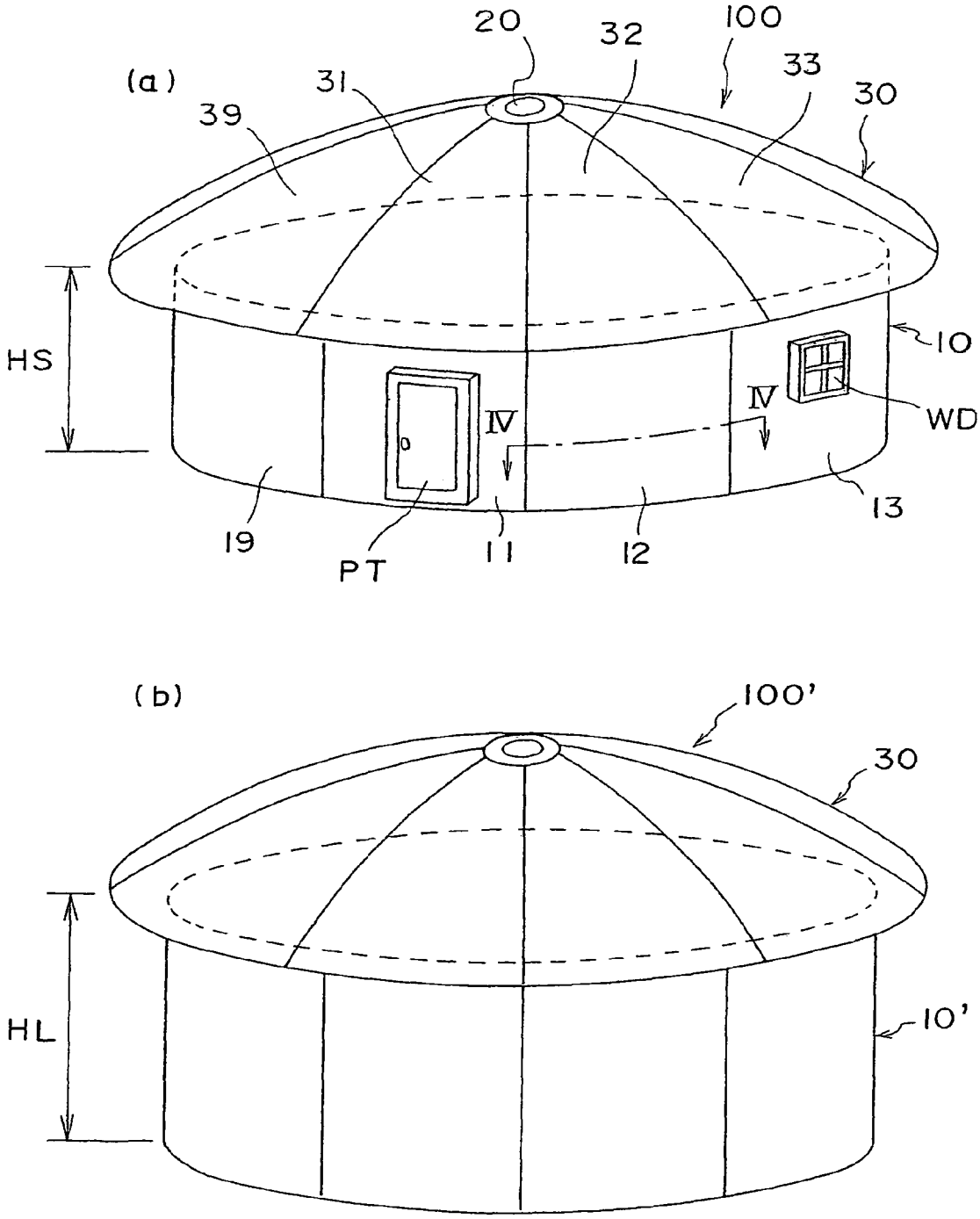
FIG. 1(*a*) is a perspective providing an overall view of the prefabricated styrene foam house achieved in a first embodiment of the present invention and FIG. 1(*b*) is a perspective of a house achieved by adjusting the height.
Figure 2:
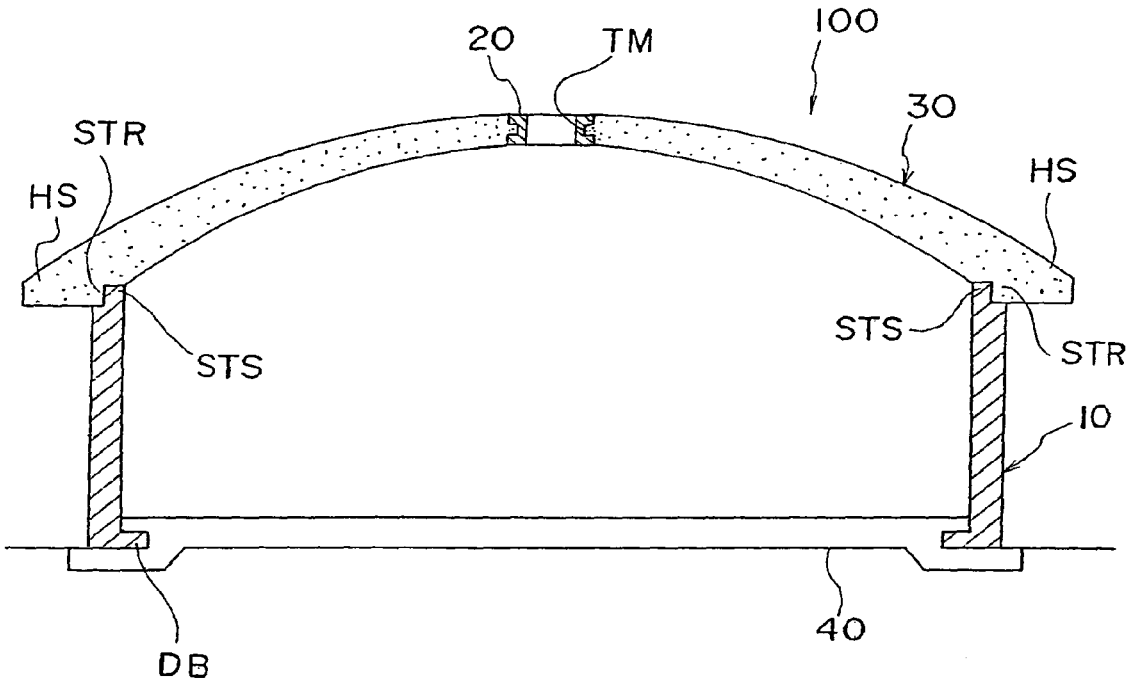
FIG. 2 is a sectional view of the prefabricated resin house in FIG. 1.
Figure 3:
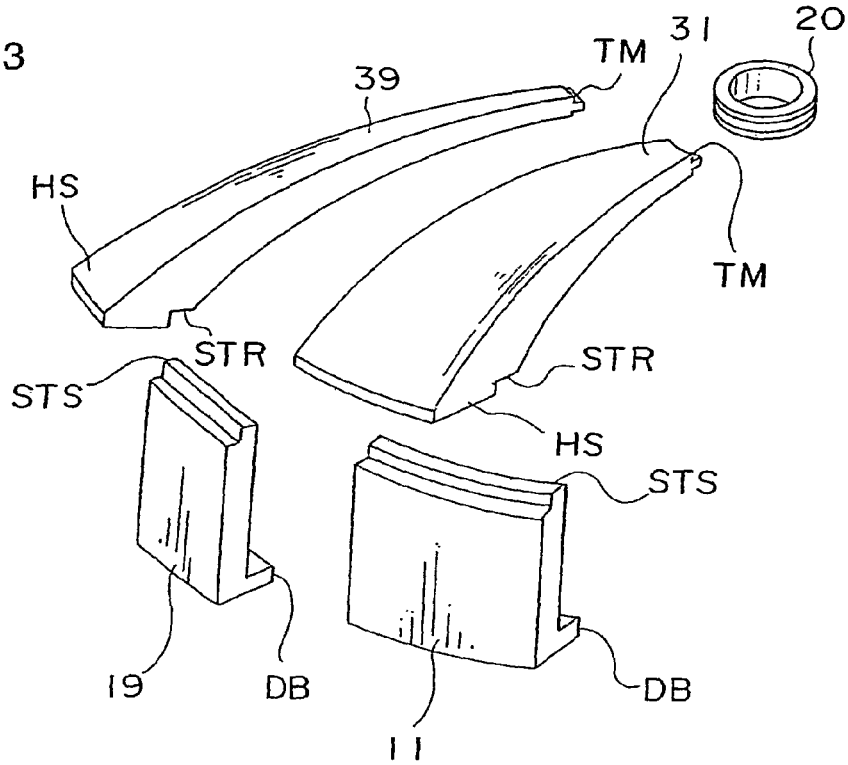
FIG. 3 is an exploded perspective of the prefabricated resin house in FIG. 1.

FIG. 1 is a perspective presenting an overall view of a prefabricated styrene foam house according to the present invention, and FIG. 2 and FIG. 3 are respectively a sectional view and an exploded perspective of the prefabricated styrene foam house. A prefabricated styrene foam house 100 includes a peripheral wall 10 constituted of styrene foam and a roof 30 constituted of styrene foam. The overall shape of the peripheral wall 10 is cylindrical. The cylindrical peripheral wall 10 is formed by assembling a plurality of peripheral wall structural members 11 through 19 each constituted of styrene foam. The roof 30 assumes an overall shape of an sphere segment which looks a bowl put upside down. The roof 30 with the shape of a sphere segment is formed by assembling a plurality of roof structural members 31 through 39 each constituted of styrene foam. A ventilating fixture 20, which is to be detailed later, is disposed at the zenith of the roof 30.

In FIG. 1(*a*), WD indicates a window portion formed in advance at a specific peripheral wall structural member and PT indicates an entry portion formed in advance at a specific peripheral wall structural member.

The plurality of peripheral wall structural members 11 through 19 and the plurality of roof structural members 31 through 39 are formed as shown in FIG. 3. These pieces are constituted by using styrene foam achieving an expansion ratio in the range of 10 through 50 and a thickness of 10 to 50 cm. For instance, at a location where the maximum snow accumulation is typically approximately 80 cm, styrene foam with an expansion ratio of 20 and a thickness of 20 cm may be used. It is to be noted that as the expansion ratio increases, the thickness, too, must increase in order to achieve a given strength. In addition, if the house is to be built in a region where snow accumulation is not an issue, the expansion ratio of the styrene foam may be set larger than 20 or the thickness of the styrene foam can be set smaller than 20 cm. If, on the other hand, the house is to be built in a region where the snow accumulation amounts to 1 m or more, the expansion ratio of the styrene foam should be reduced to 20 or less or the thickness of the styrene foam should be increased in order to assure sufficient load bearing strength.

Figure 4:
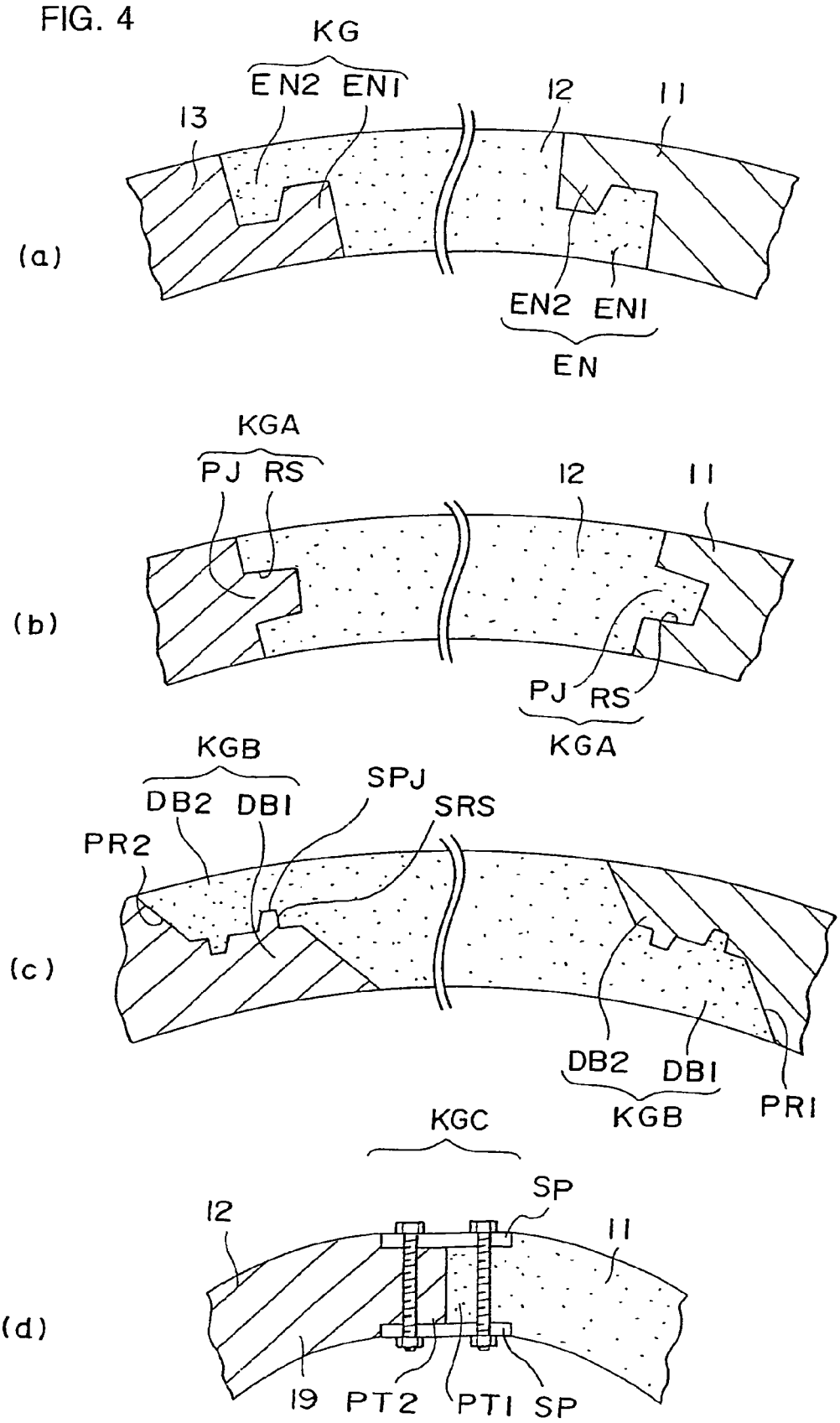
FIGS. 4(*a*) through 4(*d*) each present a sectional view that shows in detail the interlocking structure that may be adopted at side end surfaces of the peripheral wall structural members or the bonding portions at side end surfaces of the roof structural members in FIG. 1.

An L-shaped base portion DB and a staged portion STS are respectively formed at the lower end and the upper end of each of the peripheral wall structural members 11 through 19. As shown in FIG. 4(*a*), each of the peripheral wall structural members 11 through 19 include mirror-image hooking portions EN1 and EN2 formed at the side end surfaces thereof, as shown in FIG. 4(*a*). Namely, the adjacent peripheral wall structural members 11 and 12, for instance, are bonded to each other over an interlocking portion KG where the hooking portions EN1 and EN2 at their side end surfaces facing opposite each other interlock with each other.

The interlocking portion KG, where the side end surfaces of the peripheral wall structural members 11 through 19 interlock with the adjacent side end surfaces, may assume a structure other than that in FIG. 4(*a*). The peripheral wall structural members may interlock with each other by adopting, for instance, any of the structures shown in FIGS. 4(*b*) through 4(*d*).

An interlocking portion KGA shown in FIG. 4(*b*) is structured as follows. At the side end surfaces of each of the peripheral wall structural members 11 through 19, a recessed interlocking portion RS and a projecting interlocking portion PJ are formed. Namely, the recessed portion RS and the projecting portion PJ at the side end surfaces of the adjacent peripheral wall structural members 11 and 12, which face opposite each other, for instance, are fitted together and bonded to each other over the interlocking portion KGA.

An interlocking portion KGB in FIG. 4(*c*) is structured as follows. Each of the peripheral wall structural members 11 through 19 has mirror image staged portions DB1 and DB2 formed at the two side end surfaces thereof. Namely, the staged portion DB1 includes a projection PR1 formed at the internal circumferential side, the staged portion DB2 includes a projection PR2 formed toward the external circumferential side and each staged portion includes a small recessed portion SRS and a small projecting portion SPJ at the bonding surface ranging along the radial direction.

An interlocking portion KGC in FIG. 4(*d*) is structured as follows. Each of the peripheral wall structural members 11 through 19 includes butt projections PT1 and PT2 formed at the two side end surfaces thereof. Namely, a pair of the butt projections PT1 and PT2 of peripheral wall structural members 11 and 12 adjacent to each other, for instance, are joined with each other, and then bolts are tightened with joining plates SP fitted at an inner recessed portion and an outer recessed portion.

In any of these interlocking portion structures that may be adopted at the side end surfaces, the joining surfaces are machined to include steps and thus, the size of the joining area equals or exceeds a predetermined value. In addition, rainwater and the like are not allowed to enter the inner living space from the outside readily. By ensuring that the side end surfaces are joined over an area equal to or exceeding the predetermined value, an improvement in the bonding strength is achieved.

Each of the roof structural members 31 through 39 includes a notch TM having a substantially segmental arc shape, which is to constitute part of a skylight, and an eave HS formed at the lower end thereof. A staged portion STR which is to interlock with the staged portion STS of the peripheral wall structural member 11 through 19 is formed as the inner circumferential edge of the eave HS. The wall thickness of the roof structural members 31 through 39, which is at its smallest at the skylight TM, gradually increases toward the eave HS. Interlocking portions (not shown) similar to those at the peripheral wall structural members 11 through 19 are formed at the individual side end surfaces of the roof structural members 31 through 39.

Figure 5:
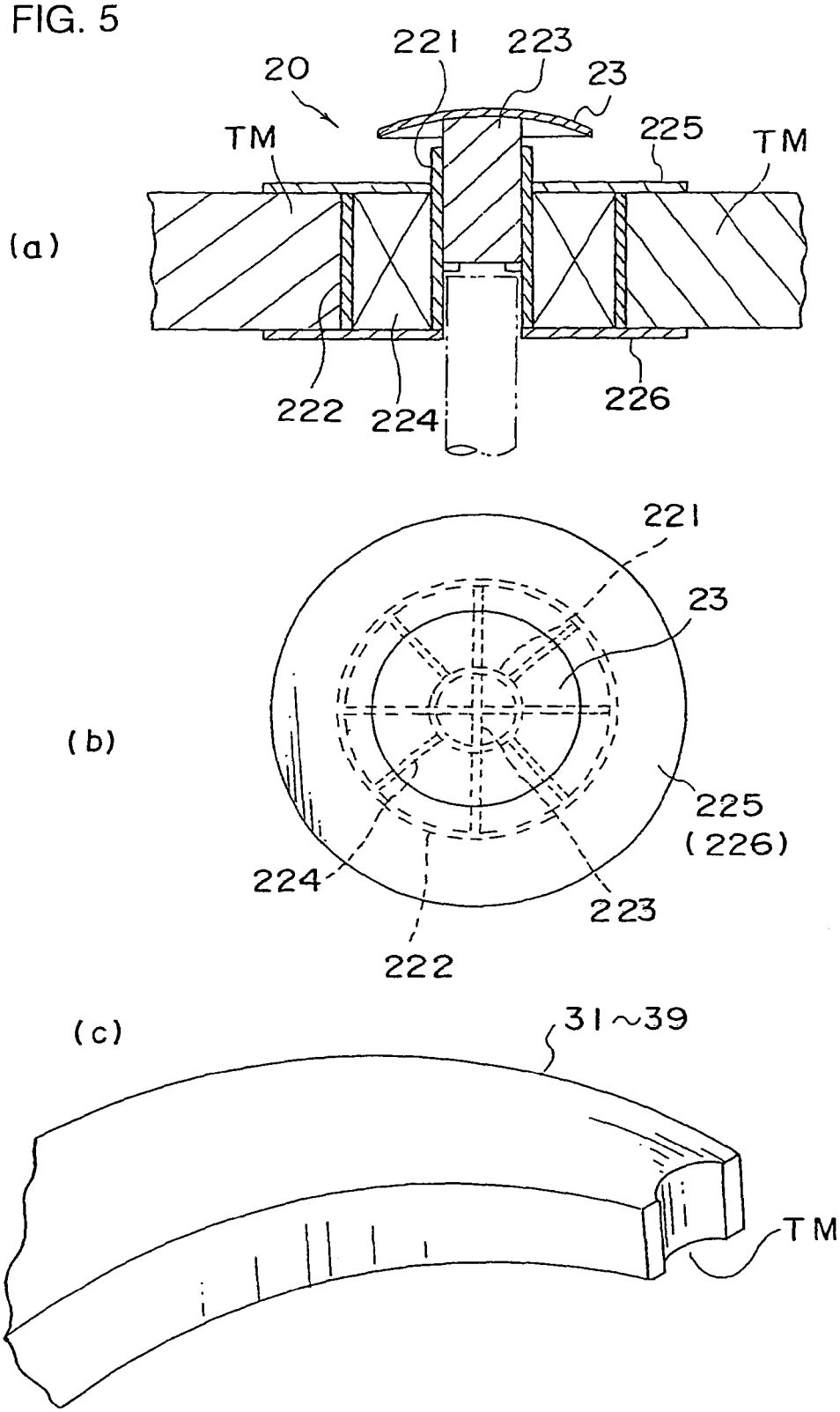
FIG. 5(*a*) is a sectional view of the fastening joint located at the top of the roof structural members, FIG. 5(*b*) is a top view of FIG. 5(*a*) and FIG. 5(*c*) is a perspective of the shape assumed in the top portion of each roof structural member.

FIGS. 5(*a*) and 5(*b*) show in detail the top joint 20. The top joint 20 includes an inner tube 221, an outer tube 222, partitioning walls 223 crossing each other at a right angle to partition the space inside the inner tube 221, partitioning walls 224 that partition the ring-shaped space between the inner tube 221 and the outer tube 222, an upper collar 225 that closes the top of the ring-shaped space between the inner tube 221 and the outer tube 222 and a lower collar 226 that closes the bottom of the ring-shaped space between the inner tube 221 and the outer tube 222. The inner tube 221 projects out beyond an upper lid 225 and the space inside the inner tube 221 is utilized as an indoor ventilation opening. A rain cover 23 is mounted at the inner tube 221 so as to disallow entry of rain and the like into the living space from the outside. It is to be noted that the notched portions TM formed at the front ends of the roof structural members 31 through 39 are fitted in and bonded between the upper collar 225 and the lower collar 226 and that the top of the roof 30 is tightened in this state, as shown in FIG. 5(*c*). The joint 20 is used as a ventilating fixture for ventilating the inner space as well. The opening at which the joint 20 is mounted may be used as a lighting opening as well.

Figure 6:
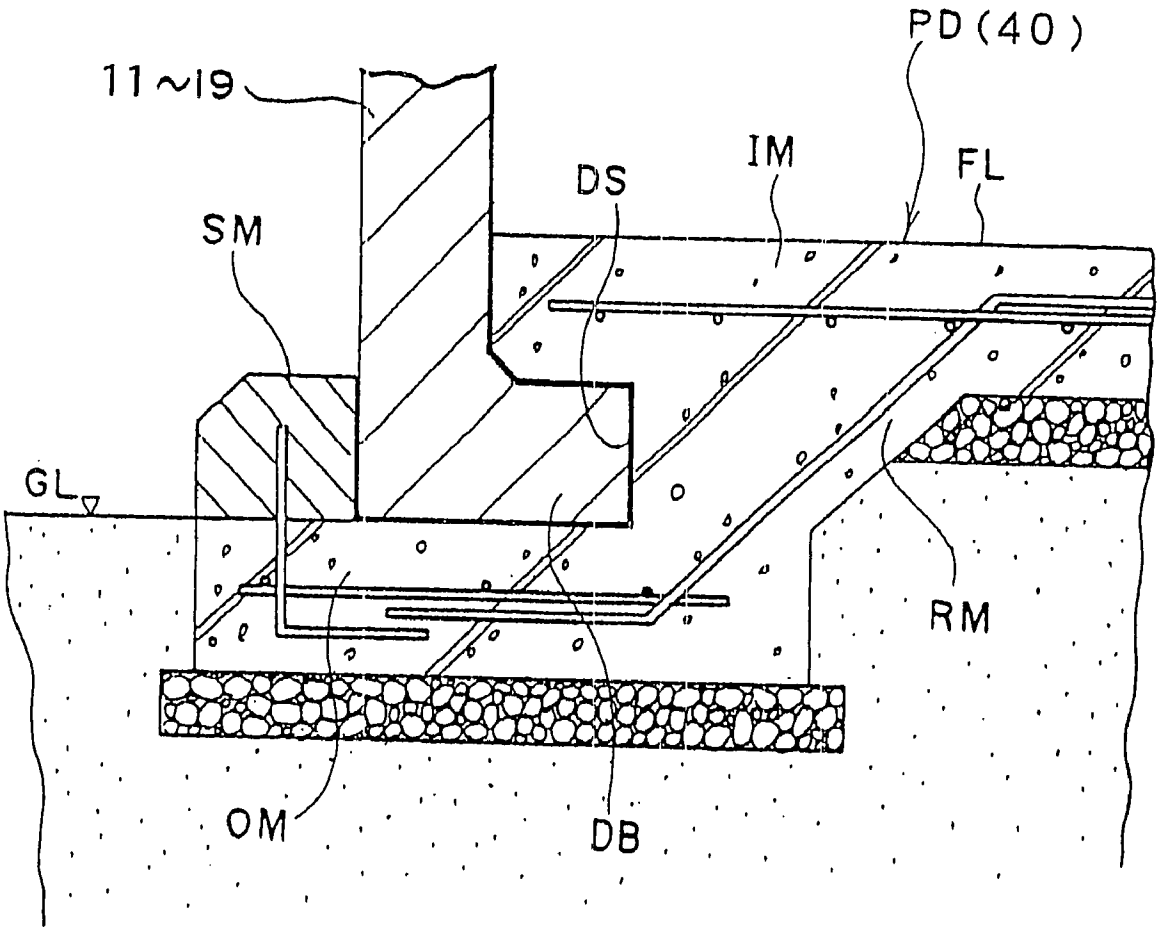
FIG. 6 is a sectional view illustrating an example of a structure that may be adopted to fix the peripheral wall structural members to the concrete foundation slab.

The peripheral wall 10 is formed by sequentially erecting the peripheral wall structural members 11 through 19 formed as described above on a foundation 40 and thus assembling them together. FIG. 6 shows in detail the structure adopted in the installation of the peripheral wall 10 (the peripheral wall structural members 11 through 19). At the location where the prefabricated house is to be built, the foundation 40 constituted of a concrete slab PD, is laid in advance. As shown in the figure, the concrete slab PD includes an inner residential portion IM which forms a floor surface FL at a position that is higher than the ground surface GL by a predetermined extent (by 360 mm, for instance), a support portion OM that supports the peripheral wall structural members 11 through 19 at a position with the same height as that of the ground surface GL and a peripheral wall structural member holding portion DS continuous from the support portion OM through the inner residential portion IM. The holding portion DS is formed as a recessed portion assuming a ring shape, and with the L-shaped base portions DB of the peripheral wall structural members 11 through 19 held at the holding portion DS, the prefabricated house can be set at a desirable position with a high degree of reliability and can also be restrained so as to prevent any displacement along the upward direction or along the lateral direction toward the inside. The surface of the inner residential portion IM achieves the shape of a circle with an external diameter of 7 m. In addition, on the circumferential sides of the bases DB, a ring-shaped restraining mortar SM is disposed along the entire circumference in order to prevent outward displacement of the base portions DB. RM in FIG. 6 indicates a reinforcing member used to reinforce the concrete PD and the mortar SM.

Now, the assembly procedure through which the peripheral wall structural members 11 through 19 and the roof structural members 31 through 39 described above are assembled to build a styrene foam house is explained. The peripheral wall 10 is formed by sequentially erecting and assembling the peripheral wall structural members 11 through 19 on the foundation 40 via their bases DB. At this time, the interlocking portions KG of the adjacent peripheral wall structural members 11 through 19 are made to interlock with and fit with each other and are then bonded with adhesive, as shown in FIG. 4(*a*).

The individual roof structural members 31 through 39 are assembled on the ground to build the roof 30. Namely, the segment shaped notches TM at the individual peripheral wall structural members 31 through 39 are interlocked with and bonded to the top joint 20 which is to function as a ventilating fixture as well and also, the side end surfaces of the roof structural members are interlocked with and bonded to each other, thereby forming the roof 30.

The roof 30 thus assembled on the ground is hoisted up with a crane and placed on the peripheral wall 10. In other words, the staged portion STR formed at the eave HS is made to interlock with the staged portions STS at the peripheral wall 10 and the staged portions are then bonded. The prefabricated resin house made of styrene foam is thus assembled.

A resin primer is then applied to the exterior surfaces and the interior surfaces of the peripheral wall 10 and the roof 30 having been assembled, and after the resin primer dries, a paint achieving weather resistance and fire resistance is applied over the resin primer. Next, the interior of the house is finished. The interior design may adopt a western-style layout which includes a kitchen, a bathroom and wooden or other flooring or a Japanese-style layout with tatami mats laid out. It is to be noted that while a detailed explanation with regard to the entrance door and the window is not provided, the prefabricated resin house includes the entrance PT and the window WD, as shown in FIG. 1. By assembling the plurality of peripheral wall structural members 11 through 19 and the plurality of roof structural members 31 through 39 constituted of styrene foam through bonding as described above, a prefabricated resin house having formed therein a living space can be constructed with ease.

The prefabricated styrene foam house built by placing the sphere segment roof 30 assembled with the roof structural members 31 through 39 on top of the cylindrical peripheral wall 10 assembled with the peripheral wall structural members 11 through 19 achieves the following advantages.

(1) Since the building structure includes two separate units, i.e., the peripheral wall 10 and the roof 30 respectively formed by using the peripheral wall structural members 11 through 19 and the roof structural members 31 through 39 instead of dome pieces each ranging continuously from the floor surface to the ceiling used in the related art, the size (the maximum length) of each structural member can be reduced and thus, the transportability is improved.

(2) By adjusting the height of the peripheral wall 10 as necessary, prefabricated houses with interior ceilings at varying heights can be manufactured. For instance, the same roof 30 may be placed on top of a peripheral wall 10' manufactured to have a height HL larger than the height HS of the peripheral wall 10, as shown in FIGS. 1(*a*) and 1(*b*). Since the same roof can be commonly used to construct houses with varying heights, as long as the diameters of the houses are equal to one another, production costs can be reduced. The building structure in the related art described above, which is achieved by using dome pieces each ranging continuously from the floor surface to the ceiling, necessitates dome pieces in a completely different size to be manufactured to achieve a different ceiling height even when the diameter of the house remains unchanged and in such a case, the increase in production costs including the cost of the mold is bound to be significant.

(3) A prefabricated accommodation facility can be built at low cost within a short period of time simply by assembling the peripheral wall structural members 11 through 19 to form the peripheral wall 10 and placing the roof 30 assembled with the roof structural members 31 through 39 on top of the peripheral wall.

(4) The peripheral wall 10 and the roof 30, both constituted of styrene foam, are completely recyclable, and thus, an environmentally friendly structure is provided.

-Variations-

Figure 7:
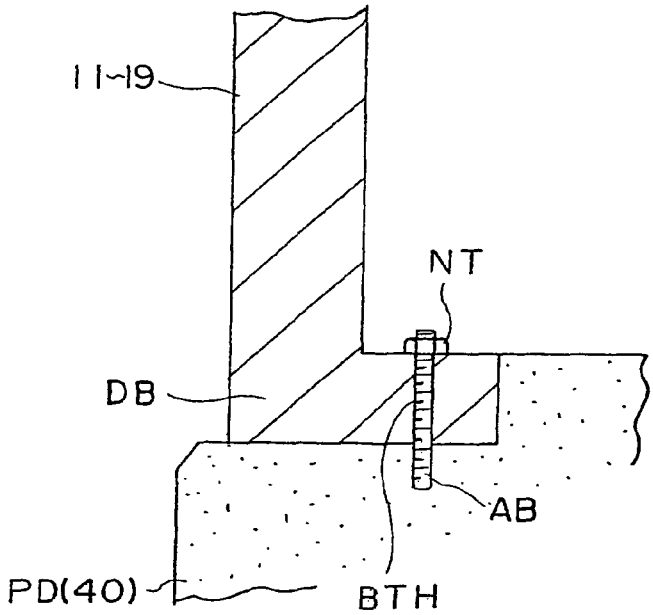
FIG. 7(*a*) is a sectional view and FIG. 7(*b*) is a perspective of another structural example that may be adopted to fix the peripheral wall structural members to the foundation.
Figure 7:
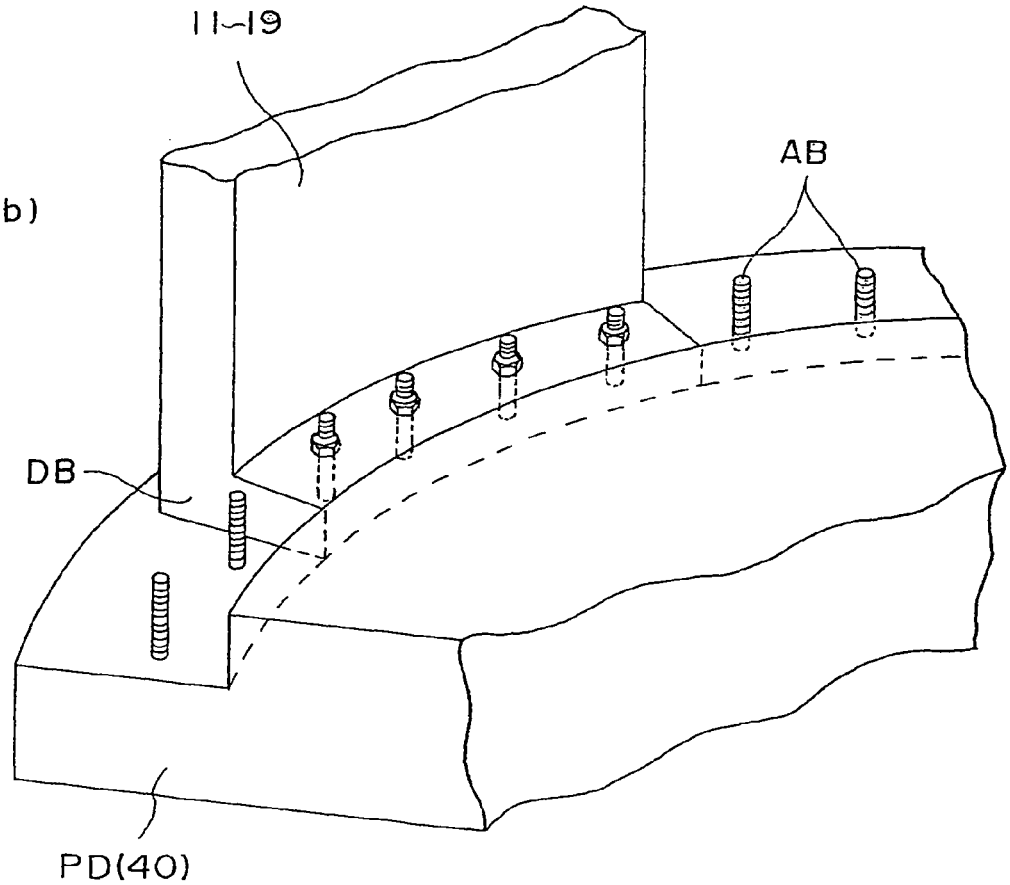

FIGS. 7(*a*) and 7(*b*) show an example of another method that may be adopted when fixing the L-shaped base portions DB of the peripheral wall 10 to the foundation. At the L-shaped base portions DB, bolt holes BTH are formed over equal intervals. Anchor bolts AB set in place at the base portion mounting surface of the foundation 40 are inserted through the bolt holes BTH and then are tightened with nuts NT.

Figure 8:
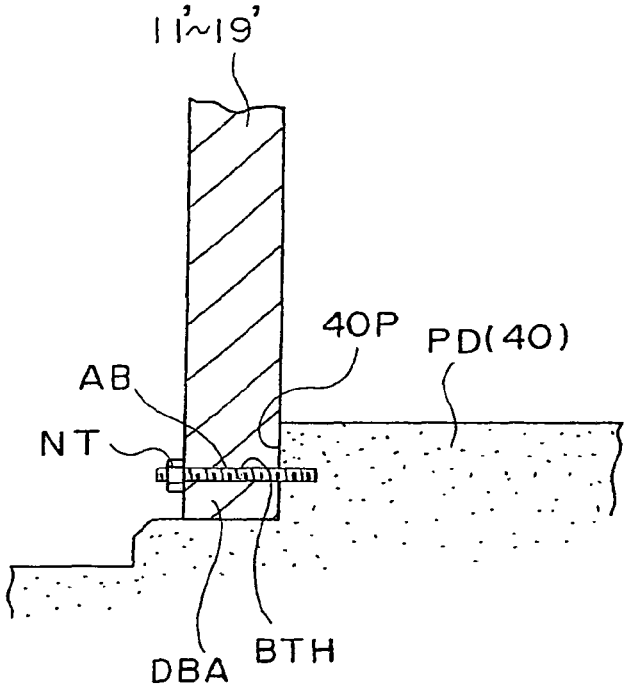
FIG. 8 is a sectional view illustrating another structural example that may be adopted to fix the dome structural members to the concrete foundation slab.

If peripheral wall structural members 11' through 19' include base portions DBA that do not have an L shape, the peripheral wall structural members 11' through 19' may be fixed to the foundation 40, as shown in FIG. 8. In this case, the base portions DBA include bolt holes BTH formed as through holes passing from the outer surface to the inner surface and anchor bolts AB set at the base portion mounting surface 40P of the foundation 40 are inserted through the bolt holes BTH and then tightened with nuts NT.

Figure 9:
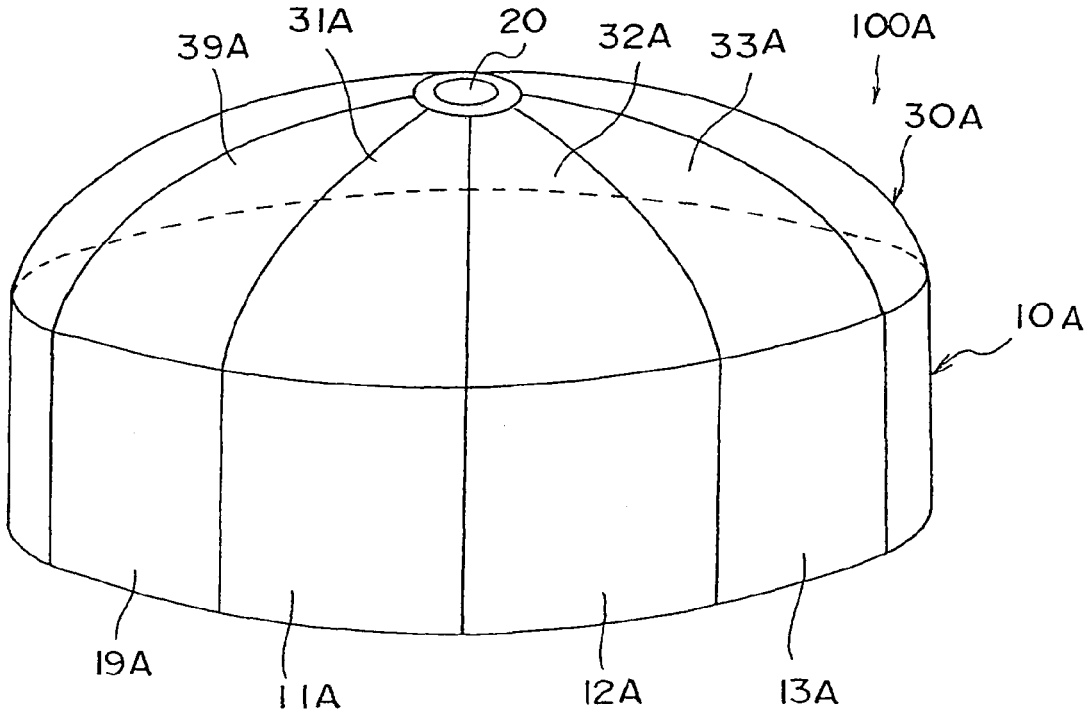
FIG. 9 is a perspective of a variation of the prefabricated resin house achieved in the first embodiment.
Figure 10:
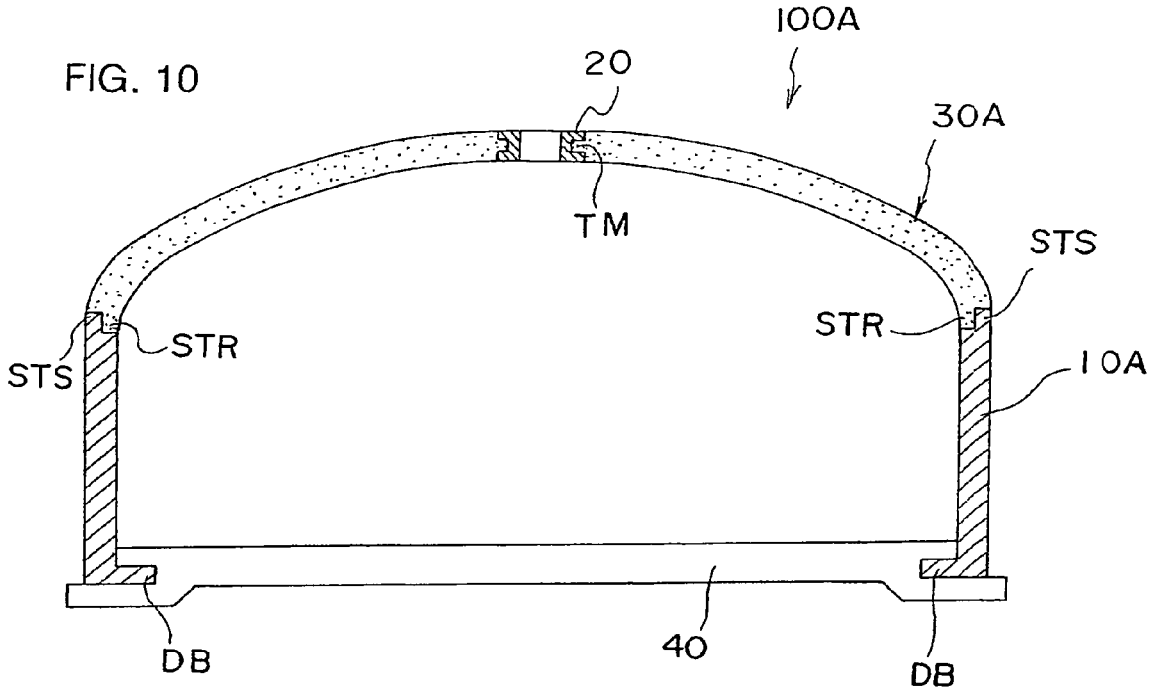
FIG. 10 is a sectional view of the prefabricated resin house achieved in the variation in FIG. 9.

As shown in FIGS. 9 and 10, the eave HS may be omitted. A prefabricated styrene foam house 100A includes a peripheral wall 10A constituted of styrene foam and a roof 30A constituted of styrene foam. The peripheral wall 10A differs from the peripheral wall 10 in FIG. 1 in the shape of the staged area at its upper end. The peripheral wall 10A in FIGS. 9 and 10 includes a staged portion STS having a lower stage on the internal circumferential side. The roof 30A, which, unlike the roof in FIG. 1, does not have an eave HS, still achieves an overall shape of a sphere segment which looks a bowl put upside down, as does the roof in FIG. 1. At the lower end of the roof 30A, a staged portion STR is formed in the shape corresponding to the shape of the staged portion STS at the peripheral wall 10A. Other structural features are similar to those shown in FIGS. 1 through 7. However, the wall thickness of the roof structural members 31A through 39A remains constant from the top through the lower end.

The peripheral wall structural members 11 through 19 may each be further divided into smaller pieces along the lengthwise (vertical) direction to further improve the transportability.

-Second Embodiment-

The second embodiment is now explained in reference to FIGS. 11 through 15. In the second embodiment, steel frame members or laminated wood members are used as strengthening members of a styrene foam house.

Figure 11:
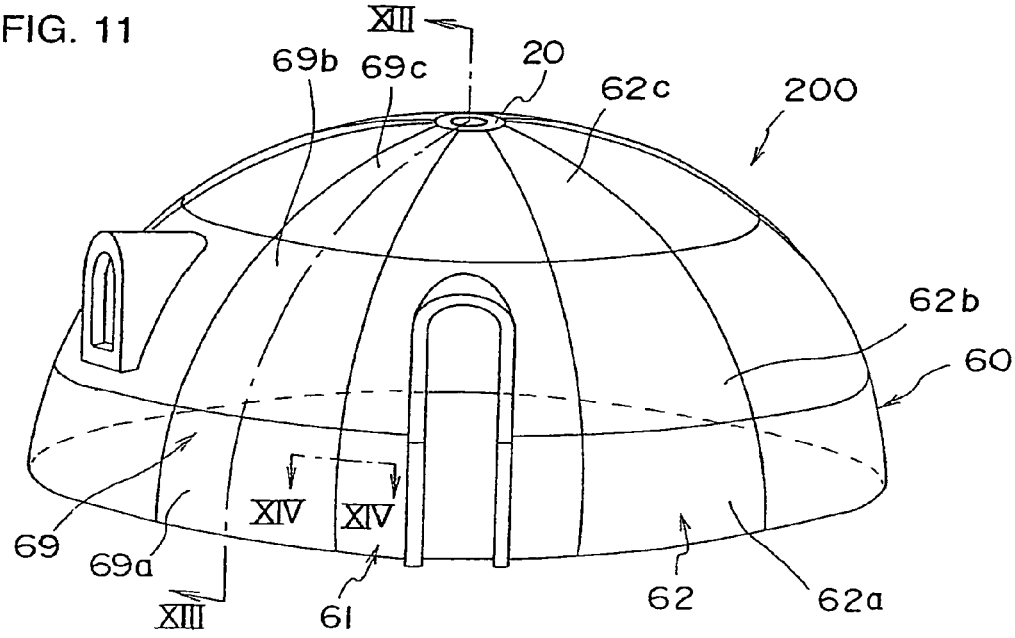
FIG. 11 is a perspective presenting an overall view of the prefabricated styrene foam house achieved in a second embodiment of the present invention.
Figure 12:
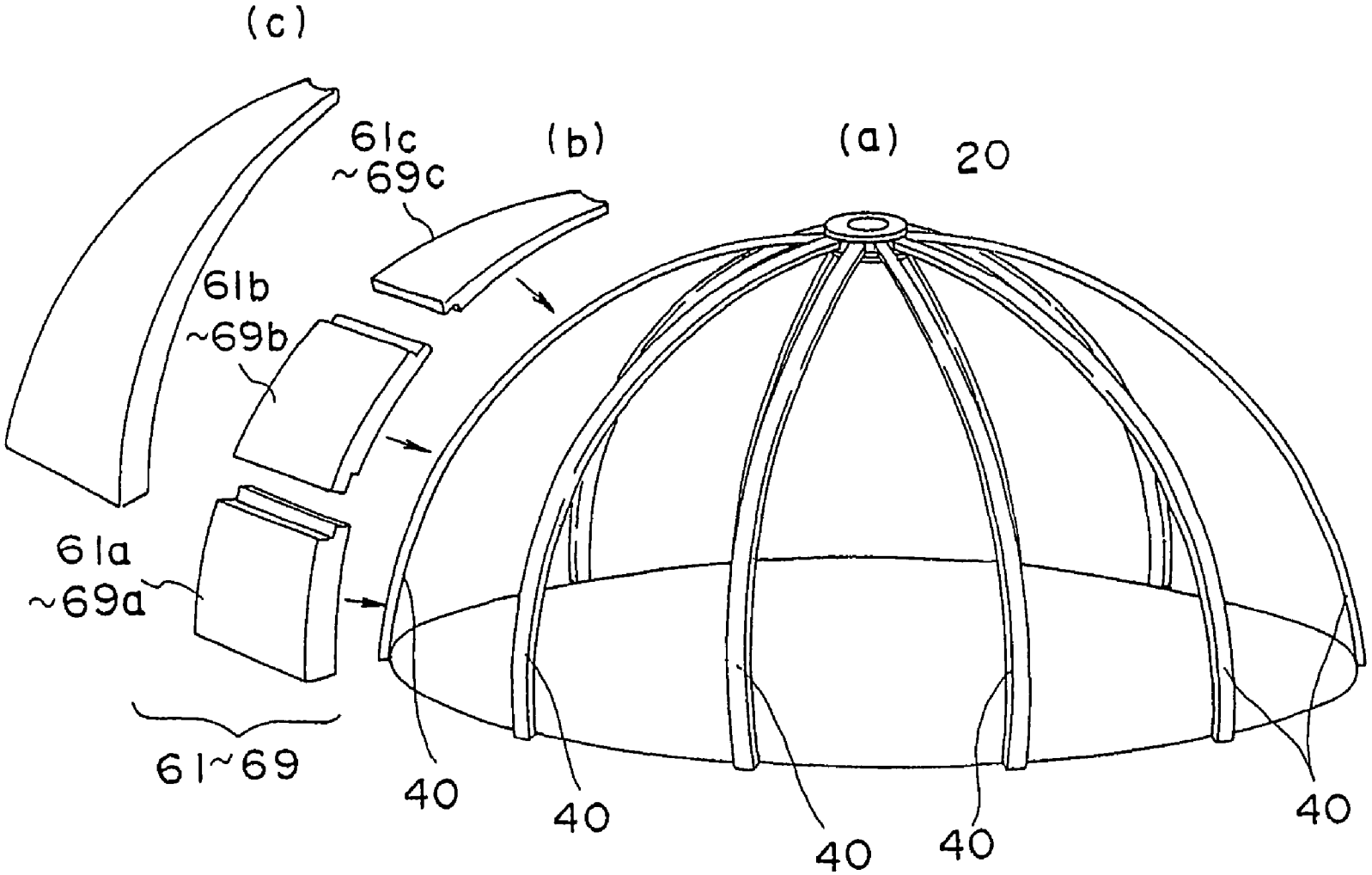
FIG. 12 is an exploded perspective of the prefabricated resin house in the second embodiment shown in FIG. 11.

FIG. 11 is a perspective presenting an overall view of the prefabricated styrene foam house achieved in the second embodiment and FIG. 12 is an exploded perspective of the prefabricated styrene foam house. The prefabricated styrene foam house 200 having a semispherical shape on the whole includes strengthening members 40 constituted of steel or laminated wood and a dome peripheral wall 60 constituted of styrene foam. The strengthening members 40, extending in an arch from a zenith 20 to the foundation surface along meridians, are disposed over equal intervals along the circumference. The dome peripheral wall 60 is formed by disposing dome peripheral wall structural members 61 through 69, which assume a substantially triangular shape when viewed from the front, between pairs of strengthening members 40. The dome peripheral wall structural members 61 through 69 are respectively constituted with a plurality of structural members 61*a* through 61*c*, 62*a* through 62*c*. . . and 69*a* through 69*c*, all formed of styrene foam.

Figure 13:
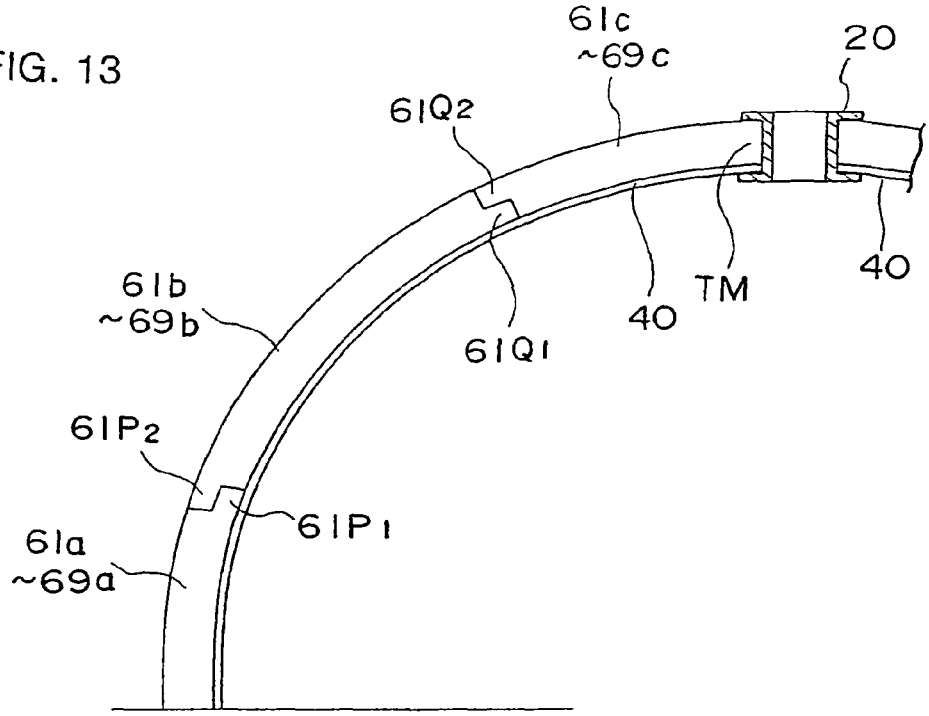
FIG. 13 is a sectional view taken along line XIII-XIII in FIG. 11.
Figure 14:
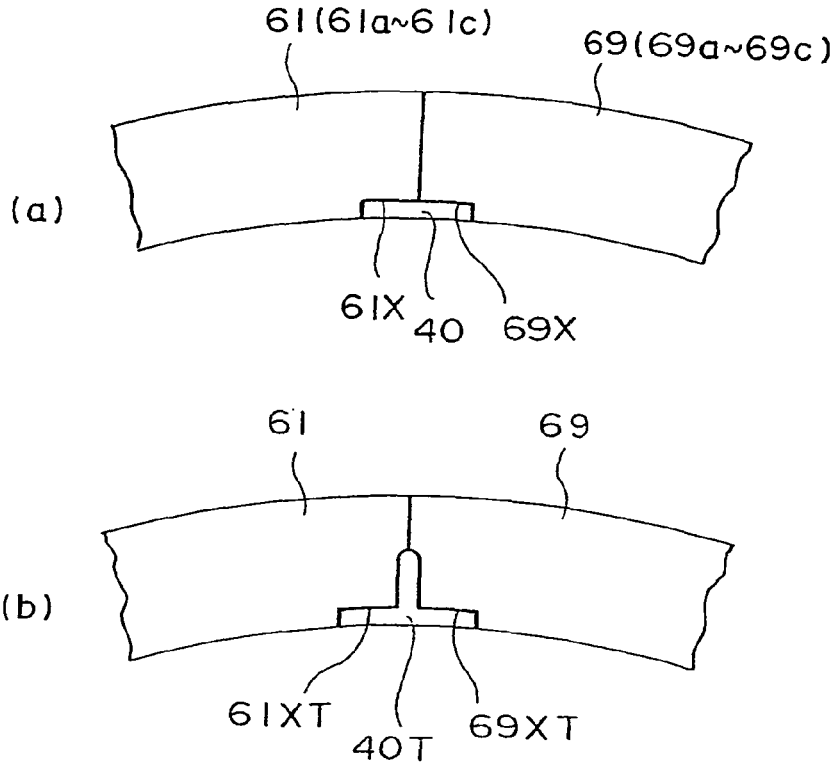
FIGS. 14(*a*) and 14(*b*) are sectional views taken along line XIV-XIV in FIG. 11.

The peripheral wall structural members 60 constituting the peripheral wall are attached to the strengthening members 40 as shown in FIGS. 13 and 14(*a*). FIG. 13 is a sectional view taken along line XIII-XIII in FIG. 11, whereas FIG. 14(*a*) is a sectional view taken along line XIV-XIV in FIG. 11. As shown in FIGS. 13 and 14(*a*), the strengthening members 40 are each formed with a steel plate strip or a laminated wood strip achieving a predetermined curvature. As shown in FIG. 14(*a*), recessed interlocking portions 61X, 62X . . . , 69X, at which the individual strengthening members 40 interlock, are formed at the joining surfaces at the side ends of the structural members 61*a* through 61*c*, 62*a* through 62*c*. . . and 69*a* through 69*c*.

As shown in FIG. 13, engaging stages are formed at joining portions at the upper and lower ends of the structural members 61*a* through 61*c* constituting the peripheral wall structural member 61, 62*a* through 62*c* constituting the peripheral wall structural member 62 . . . , and 69*a* through 69*c* constituting the peripheral wall structural member 69. To explain this in further detail in reference to FIG. 13, a staged portion 61P1, which includes a recessed side located toward the external circumference, is formed at the upper end of the bottom structural member 61*a*, a staged portion 61P2, which includes a recessed side located toward the internal circumference, and a staged portion 61Q1, which includes a recessed side located toward the external circumference, are respectively formed at the lower end and the upper end of the middle structural member 61*b*, and a staged portion 61Q2 having a recessed side located toward the internal circumference is formed at the lower end of the upper structural member 61*c*. The joining portions at the individual structural members 61*a* through 61*c* at the bottom, the middle and the top are interlocked and bonded to each other at the staged portions 61P1 through 61Q2 described above. The notch TM mentioned previously is formed at the zenith of the top structural member 61*c*, and the top structural member is linked with the zenith joint 20 at the notch TM.

The peripheral wall structural member 61, for instance, is formed by assembling the bottom, middle and top structural members 61*a* through 61*c* in the space formed between a pair of strengthening members 40. Namely, the bottom structural member 61*a* is first set upright on the foundation. It is to be noted that although not shown, the bottom structural members 61*a* through 69*a* include engaging base portions similar to the L-shaped base portions DB described earlier, at which the bottom structural members can be made to interlock with and fixed to the foundation 40. The recessed interlocking portions 61X at the side end surfaces on the left side and the right side of the bottom structural member 61*a* are fitted with and bonded to the strengthening members 40. Then, the lower staged portion 61P2 of the middle structural member 61*b* is interlocked with the upper staged portion 61P1 of the bottom structural member 61*a* and the middle structural member and the bottom structural member are bonded to each other in this state. At the same time, the recessed interlocking portions 61X at the side end surfaces on the left side and the right side of the middle structural member 61*b* are fitted with and bonded to the strengthening members 40. Lastly, the lower staged portion 61Q2 of the top structural member 61*c* is interlocked with the upper staged portion 61Q1 of the middle structural member 61*b* and the top structural member and the middle structural member are bonded to each other in this state, while, at the same time, the recessed interlocking portions 61X at the side end surfaces on the left side and the right side of the top structural member 61*c* are fitted with and bonded to the strengthening members 40. Then, the recessed skylight portion TM at the uppermost end of the top structural member 61*c* is connected with and bonded to a skylight frame 20. The peripheral wall structural members 62 through 69, too, are assembled along the strengthening members 40 in a similar manner.

Strengthening members 40T achieving a T shape, as shown in FIG. 14(*b*), may be used. In conjunction with such strengthening members 40T, the adjacent joining surfaces of the peripheral wall structural members 61 through 69 should assume a specific shape, e.g., recessed portions 61XT and 69XT formed at the joining surfaces of the peripheral wall structural members 61 and 69 facing opposite each other, so as to form a T-shaped recessed portion when the peripheral wall structural members are joined with each other at the joining surfaces. Such recessed portions 61XT and 69XT should be formed at all the structural members, the bottom, middle and top structural members 61*a* through 61*c*, 62*a* through 62*c*. . . , and 69*a* through 69*c* along the strengthening members 40A.

The assembly procedure adopted in the second embodiment is now explained. The concrete slab PD is first laid. An auxiliary support 31 is set up at the center of the concrete slab PD, and the top joint is mounted at the front end of the support 31. The lower ends of the strengthening members 40 are connected and fixed to the connecting portions at the concrete slab, and their upper ends are connected to the top joint 20. The structural members 61*a* through 61*c*. . . , and 69*a* through 69*c* are placed between pairs of strengthening members 40, as explained earlier. The structural members 61*a* through 61*c*. . . , and 69*a* through 69*c* are bonded to the strengthening members 40 with an adhesive applied onto the joining surfaces at the structural members 61*a* through 61*c*. . . , and 69*a* through 69*c* and the joining surfaces at the strengthening members 40.

A resin primer is applied to the exterior surfaces and the interior surfaces of the dome structural members having become assembled into the semispherical shape, and after the resin primer dries, a paint achieving high levels of weather resistance and fire resistance is applied over the resin primer, as in the first embodiment. The interior appointments are laid out as in the first embodiment, as well. While a detailed explanation of an entrance door or a window is not provided, the dome includes an entry portion PT and a window portion WD as does the house shown in FIG. 1. By bonding together the plurality of structural members 61*a* through 61*c*. . . , and 69*a* through 69*c* constituted of styrene foam as described above, a dome having formed therein a semispherical living space is built. Accordingly, advantages similar to the advantages (1) through (4) of the prefabricated resin house in the first embodiment can be achieved.

Figure 15:
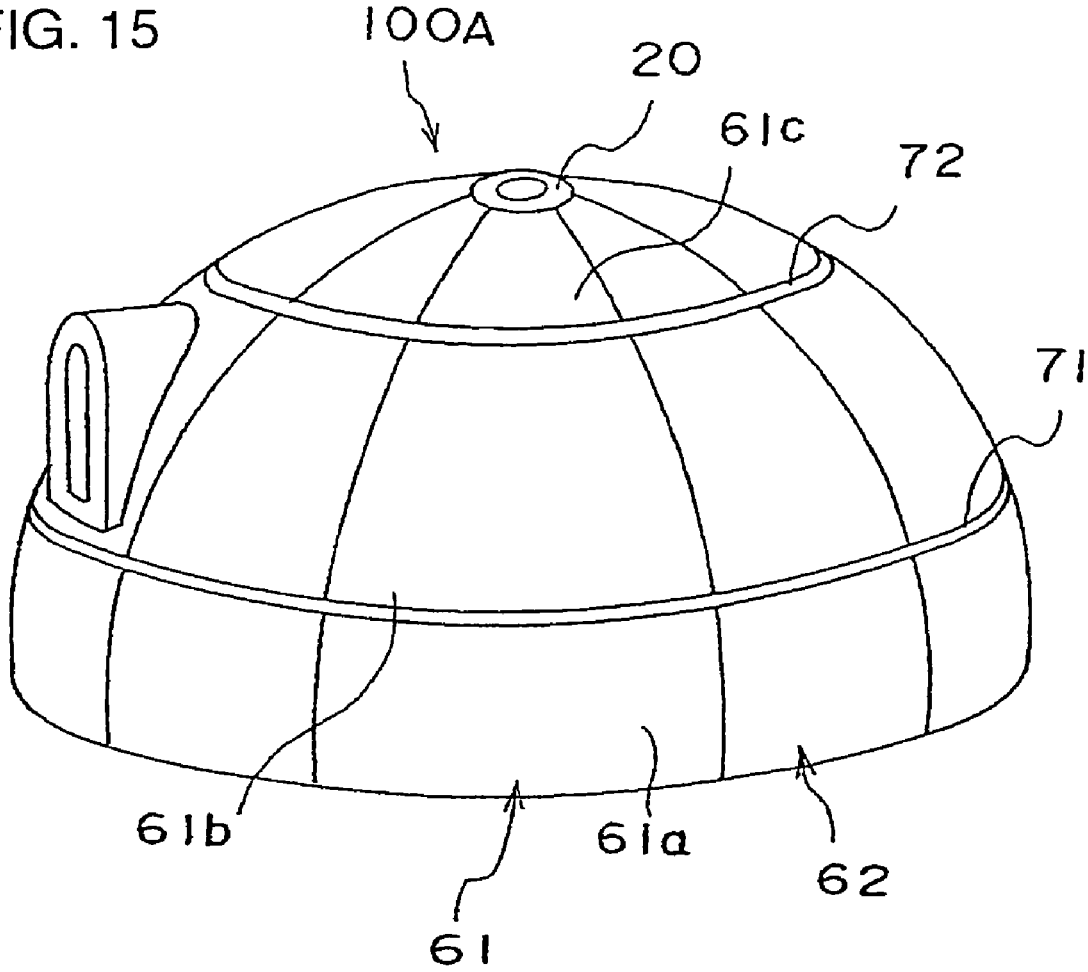
FIG. 15 is a perspective of the prefabricated styrene foam dome achieved in the second embodiment having tie bands for tightening.

Bands 71 and 72 may be placed around the dome along latitudinal lines K1 and K2 in alignment to which the structural members 61*a*. . . , and 69*a* are joined with the structural members 61*b*. . . , and 69*b* and the structural members 61*b*. . . , and 69*b* are joined with the structural members 61*c*. . . , and 69*c* in the individual peripheral wall structural members 61 through 69, as shown in FIG. 15. As the bands 71 and 72 hold the structural members 61*a* through 61*c*. . . , and 69*a* through 69*c* from the external circumferential side, the structural members are fixed onto the strengthening members 40 with a high degree of reliability. In addition, the presence of such bands prevents entry of rainwater through the bonding surfaces.

Similar advantages may be achieved by assembling a plurality of structural members constituted of a resin material such as fiber reinforced plastic (FRP) instead of styrene foam to create therein a living space, a store space or any of various commercial spaces. Since structures and assembly procedures that may be adopted in conjunction with FRP are similar to those explained above, their explanation is omitted. It is desirable to form a resin concrete layer over the interior surface and the exterior surface of the structure made of FRP as well. In addition, since the soundproofing performance and the thermal insulation performance of FRP are not as good as those of styrene foam, it is desirable to spray styrene foam onto the interior surface and then to spray resin concrete over the styrene foam. The durability of the structure can be improved by forming a layer constituted of a weather resistant material at the outermost surface of the structure. Even in the event of an earthquake, a typhoon or the like destroying the house constituted of styrene foam or FRP, the extent of injury sustained by residents can be minimized.

It is to be noted that the dome 200 achieved in the second embodiment includes a plurality of strengthening members 40 extending in an arch from the zenith of the dome 200 to the foundation along meridians, which are disposed over predetermined intervals along the circumferential direction, and a resin peripheral wall 60 assembled by stacking a plurality of structural members 61*a* through 61*c*. . . , 69*a* through 69*c*, each set of which is placed between a pair of strengthening members 40 and includes a plurality of structural members separated along meridians. However, the peripheral wall structural members 61 through 69 may each be constituted of a single peripheral wall structural member instead of a plurality of structural members, as shown in FIG. 12(*c*). While the transportability of such peripheral wall structural members is not as good, the strength of the entire dome structure can be further improved by using them in conjunction with the strengthening members 40.

-Third Embodiment-

While the prefabricated styrene foam houses 100 and 200 achieved in the first and second embodiments described above assume a cylindrical shape and a semispherical shape respectively, a prefabricated styrene foam house 300 achieved in the third embodiment adopts a substantially rectangular parallelepiped shape, and more precisely a loaf shape (like a Quonset but or a Nissen hut) achieved by rounding the upper surface of a rectangular parallelepiped.

Figure 16:
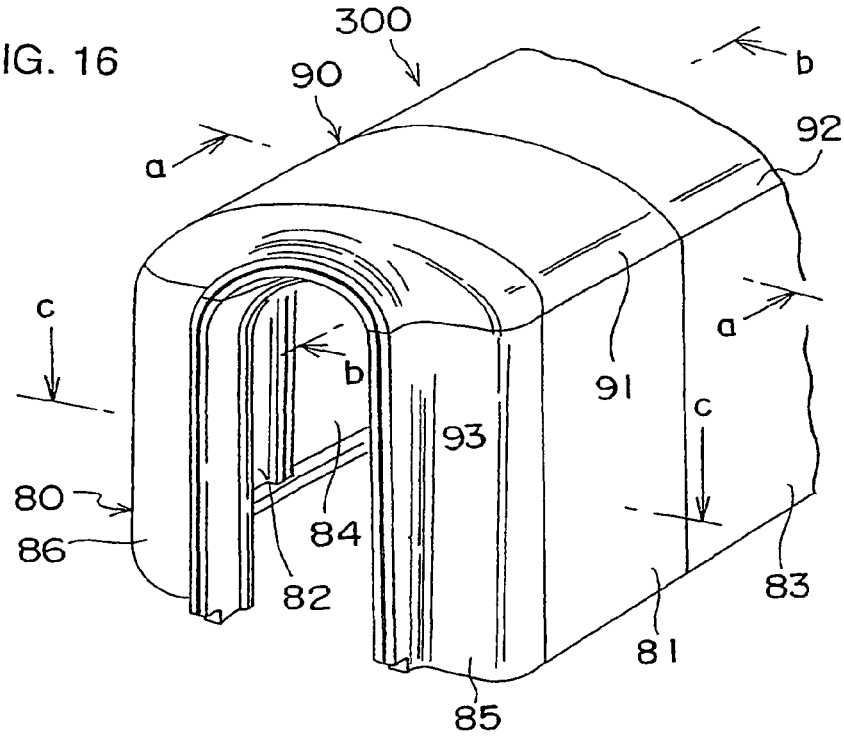
FIGS. 16(*a*) and 16(*b*) are perspectives of the prefabricated styrene foam house achieved in a third embodiment of the present invention.
Figure 16:
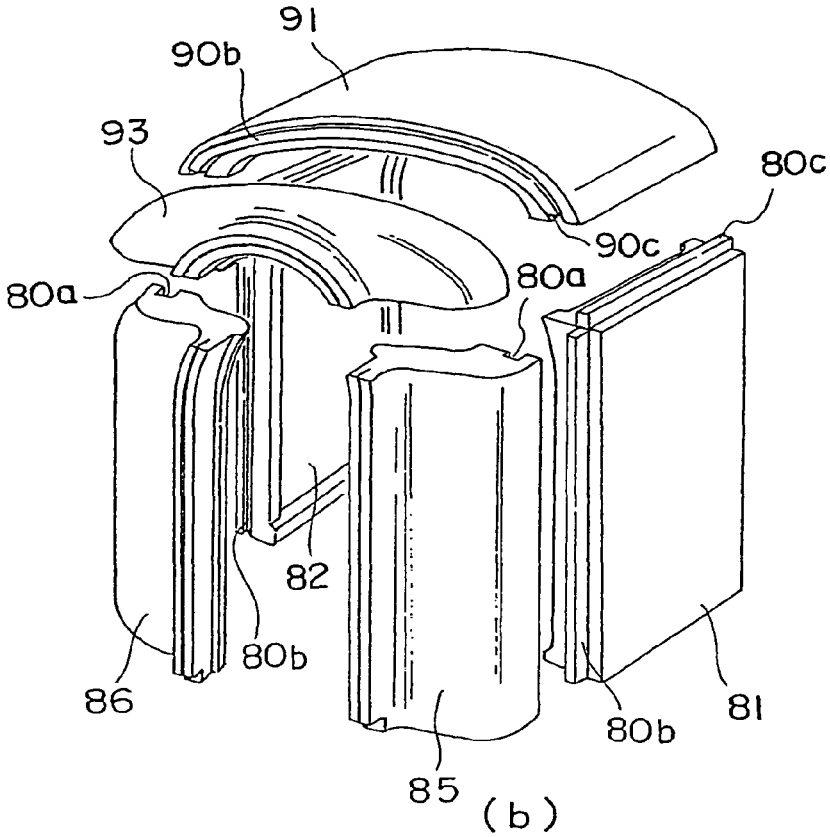

FIG. 16(*a*) is a perspective of the prefabricated styrene foam house achieved in the third embodiment in an assembled state, and FIG. 16(*b*) is an exploded perspective of the prefabricated styrene foam house. The prefabricated styrene foam house 300 includes a peripheral wall 80 and a roof 90 both constituted of styrene foam. The peripheral wall 80 includes flat peripheral wall structural members 81 and 82 facing opposite each other, flat peripheral wall structural members 83 and 84 facing opposite each other and a pair of peripheral wall structural members 85 and 86 having a substantially S-shaped section. The roof 90 includes roof structural members 91 through 93 which bridge in a circular arc over the space created between the peripheral wall structural members 81 and 82, between the peripheral wall structural members 83 and 84 and the peripheral wall structural members 85 and 86. Namely, the prefabricated styrene foam house 300 is formed by assembling a plurality of peripheral wall structural members 81 through 86 and a plurality of roof structural members 91 through 93. It is to be noted that a large house 300 can be formed by assembling greater numbers of peripheral wall structural members and roof structural members, without having to increase the sizes of the individual styrene foam pieces.

Figure 17:
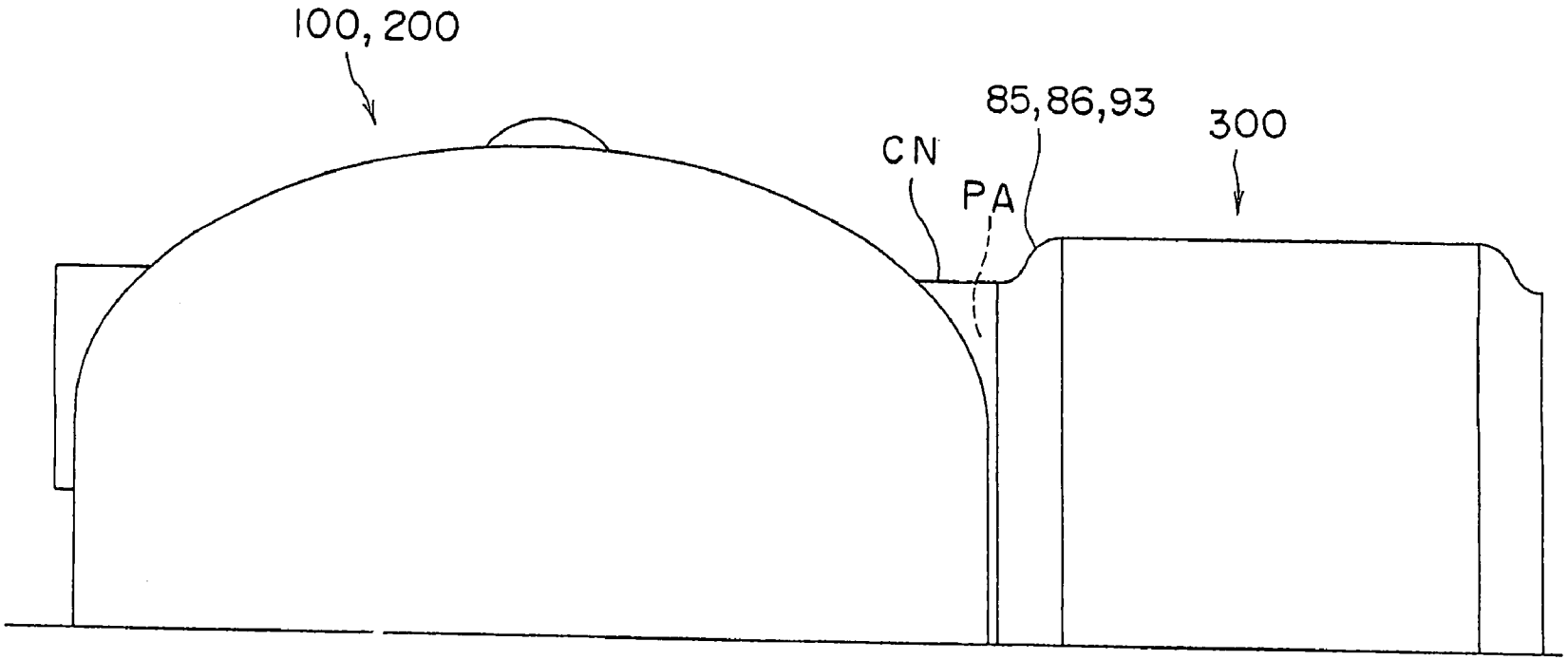
FIG. 17 is a side elevation of a structure achieved by connecting the house shown in FIG. 1 or FIG. 11 with the house shown in FIG. 16.

While this house 300 assuming a loaf shape may be used by itself, it may also be utilized in conjunction with the cylindrical or semispherical house 100 or 200, by connecting them as shown in FIG. 17. The two structures may be connected via a connecting portion CN such as a door PT. By connecting the house 300 with a loaf shape with the house 100 or 200 assuming a cylindrical shape or a semispherical dome shape as described above and communicating the individual indoor spaces via an internal passage PA, a more versatile living space can be formed with ease.

Figure 18:
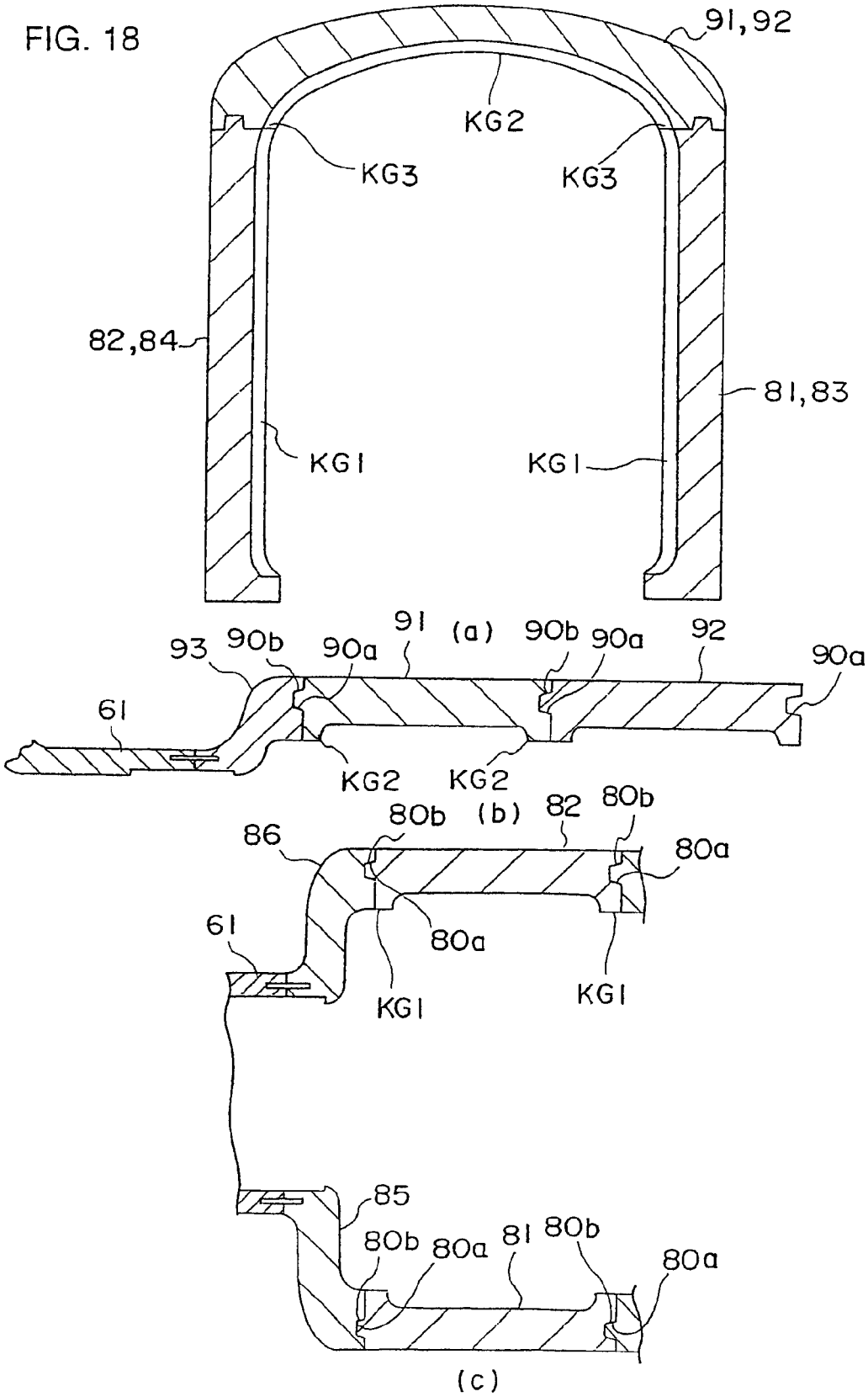
FIG. 18(*a*) is a sectional view taken along line a-a in FIG. 16(*a*), FIG. 18(*b*) is a sectional view taken along line b-b in FIG. 16(*a*) and FIG. 18(*c*) is a sectional view taken along line c-c in FIG. 16(*a*)

FIG. 18(*a*) is a longitudinal sectional view (taken along line a-a in FIG. 16(*a*)) of the house 300, FIG. 18(*b*) is a longitudinal sectional view (taken along line b-b perpendicular to line a-a in FIG. 16(*a*)) of the roof 90 and FIG. 18(*c*) is a horizontal sectional view (taken along line c-c in FIG. 16(*a*)) of the peripheral wall 80. It is to be noted that the connecting portion at which the house 300 connects with, for instance, the dome-shaped house 200 (at its peripheral wall structural members 61 shown in FIG. 11) is also shown in FIGS. 18(*b*) and 18(*c*).

As shown in FIGS. 16(*b*) and 18, a recessed interlocking portion 80*a* and a projecting interlocking portion 80*b* are formed at the side end surfaces of each of the peripheral wall structural members 81 to 84, a recessed interlocking portion 80*a* is formed at side end surface of each of the peripheral wall structural members 85 and 86 and a recessed interlocking portion 80*c* is formed at the upper end surface of each of the peripheral wall structural members 81 through 86. In addition, a recessed interlocking portion 90*a* and a projecting interlocking portion 90*b* are formed at the side end surfaces of each of the roof structural members 91 and 92, a recessed interlocking portion 90*a* is formed at a side end surface of the roof structural member 93 and a projecting interlocking portion 90*c* is formed at the lower end surface of each of the roof structural members 91 through 93. Adjacent peripheral wall structural members are coupled to each other by fitting the projecting portion 80*b* of a peripheral wall structural member in the recessed portion 80*a* at the side end surface of the adjacent peripheral wall structural member and then by bonding the peripheral wall structural members to each other. Roof structural members are coupled with each other by fitting the projecting portion 90*b* of the roof structural member into the recessed portion 90*a* at the side end surface of the adjacent roof structural member and then bonding the roof structural members to each other. A peripheral wall structural member and a roof structural member are coupled with each other by fitting the projecting portion 90*c* at the lower end surface of a roof structural member into the recessed portion 80*c* at the upper end surface of the adjacent peripheral wall structural member and then bonding the peripheral wall structural member and the roof structural member to each other.

Interlocking portions KG1 (80*a* and 80*b*) at which the peripheral wall structural members 81 through 86 are connected and interlocking portions KG2 (90*a* and 90*b*) at which the roof structural members 91 through 93 are connected, all project toward the center of the living space and the wall thicknesses at the interlocking portions KG1 and KG2 are greater than the wall thickness in the remaining part of the structure. Thus, the peripheral wall structural members can be bonded to each other over a significant bonding area and the roof structural members can be bonded to each other over a significant bonding area as well to achieve greater strength at the interlocking portions KG1 and KG2. In addition, since a ribbed structure is adopted in the interlocking portions KG1 and KG2, the strength of the entire house structure, as well as the interlocking portions KG1 and KG2, is improved. Ribs RB may be disposed over the interlocking portions KG1 and KG2 where the peripheral wall structural members and the roof structural members are connected with each other, as shown in FIG. 19(*a*), or they may be disposed at positions other than the interlocking portions KG1 and KG2 in addition to the interlocking portions KG1 and KG2, as shown in FIG. 19(*b*).

Interlocking portions KG3 at which the peripheral wall structural members 81 through 86 are connected with the roof structural members 91 through 93 are formed to have a greater wall thickness than the remaining part of the structure, as shown in FIG. 18(*a*), and the interlocking portions KG3 function as brace members. In addition, the greater wall thickness increases the size of the bonding area as over which the peripheral wall structural members 81 through 86 are bonded to the roof structural members 91 through 93, thereby assuring a high level of connection strength and also a high level of strength in the interlocking portions KG3.

Figure 19:
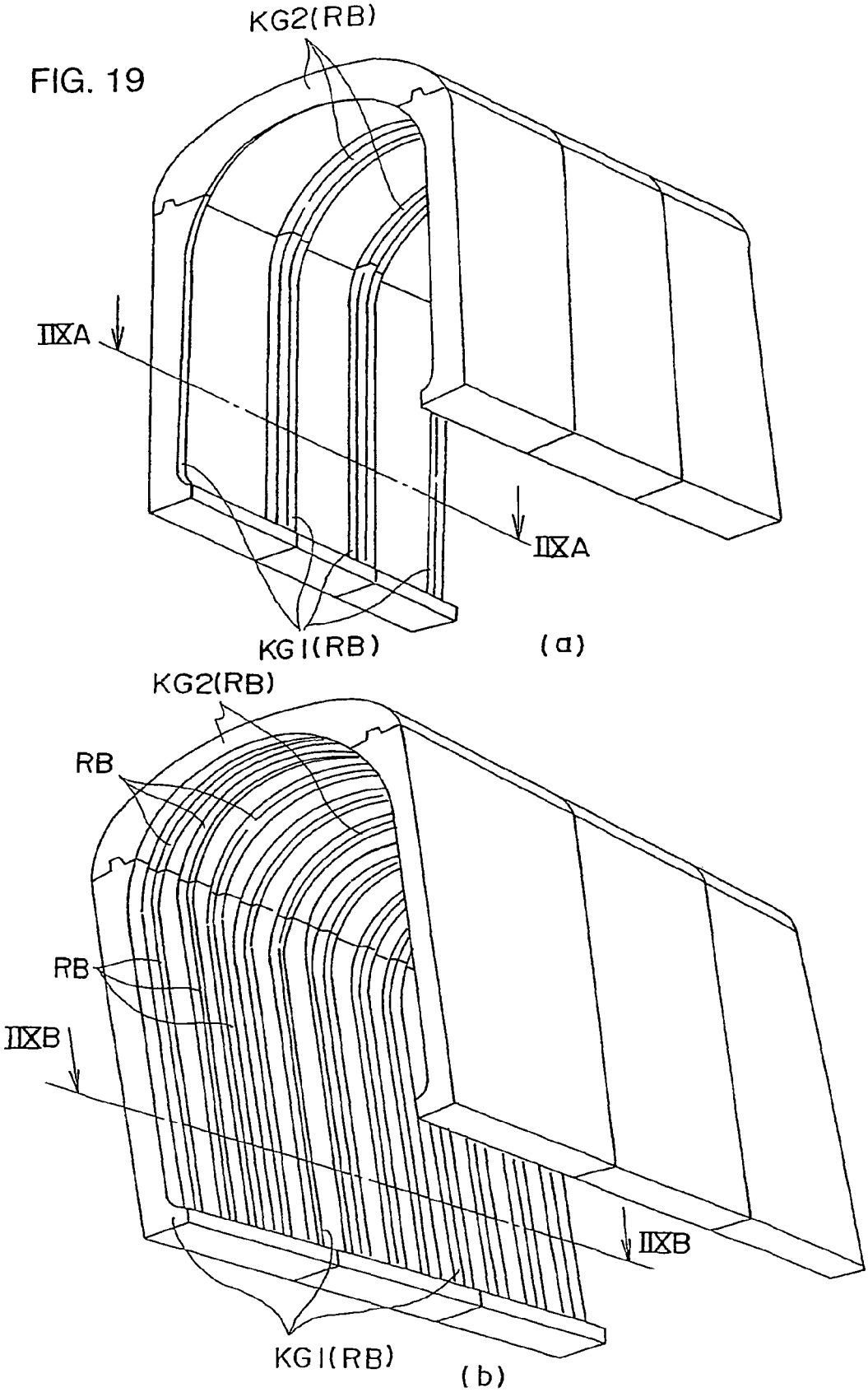
FIGS. 19(*a*) and 19(*b*) are perspectives showing internal ribbed structures that may be adopted in the prefabricated styrene foam house in the third embodiment.
Figure 20:
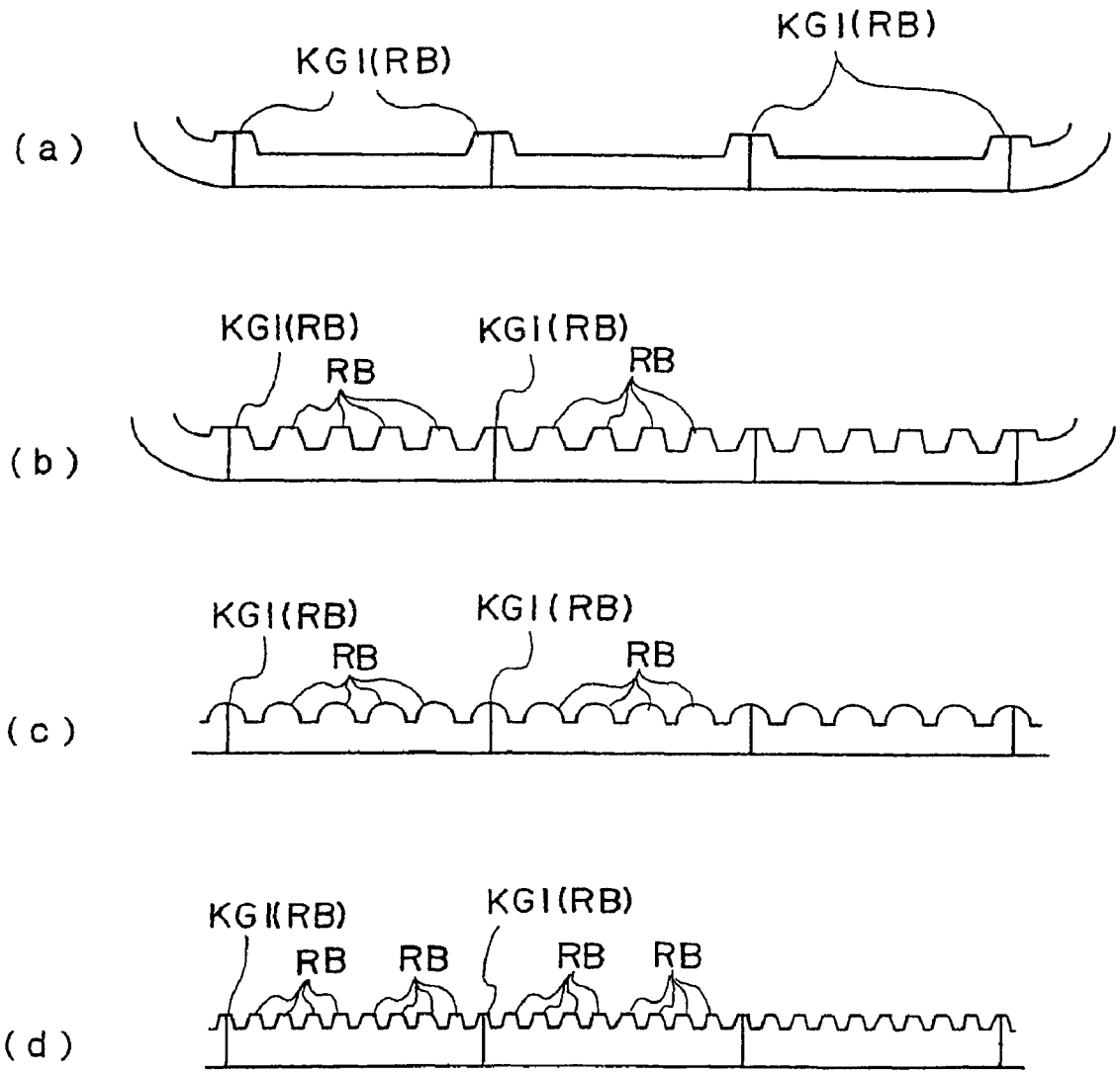
FIG. 20(*a*) is a sectional view taken along line IIXA-IIXA in FIG. 19(*a*) and FIGS. 20(*b*) through 20(*d*) are sectional views taken along lines IIXB-IIXB in FIG. 19(*b*)

FIG. 20(*a*) is a sectional view taken along line IIXA-IIXA in FIG. 19(*a*), and FIGS. 20(*b*) to FIG. 20(*d*) are sectional views taken along line IIXB-IIXB in FIG. 19(*b*). The ribs RB may take on any of various sectional shapes. Namely, they may have an angular section as shown in FIGS. 20(*a*) and 20(*b*) or they may have a rounded section as shown in FIG. 20(*c*). In addition, the pitch of the ribs RB may be reduced, as shown in FIG. 20(*d*), to achieve a corrugated shape.

Figure 21:
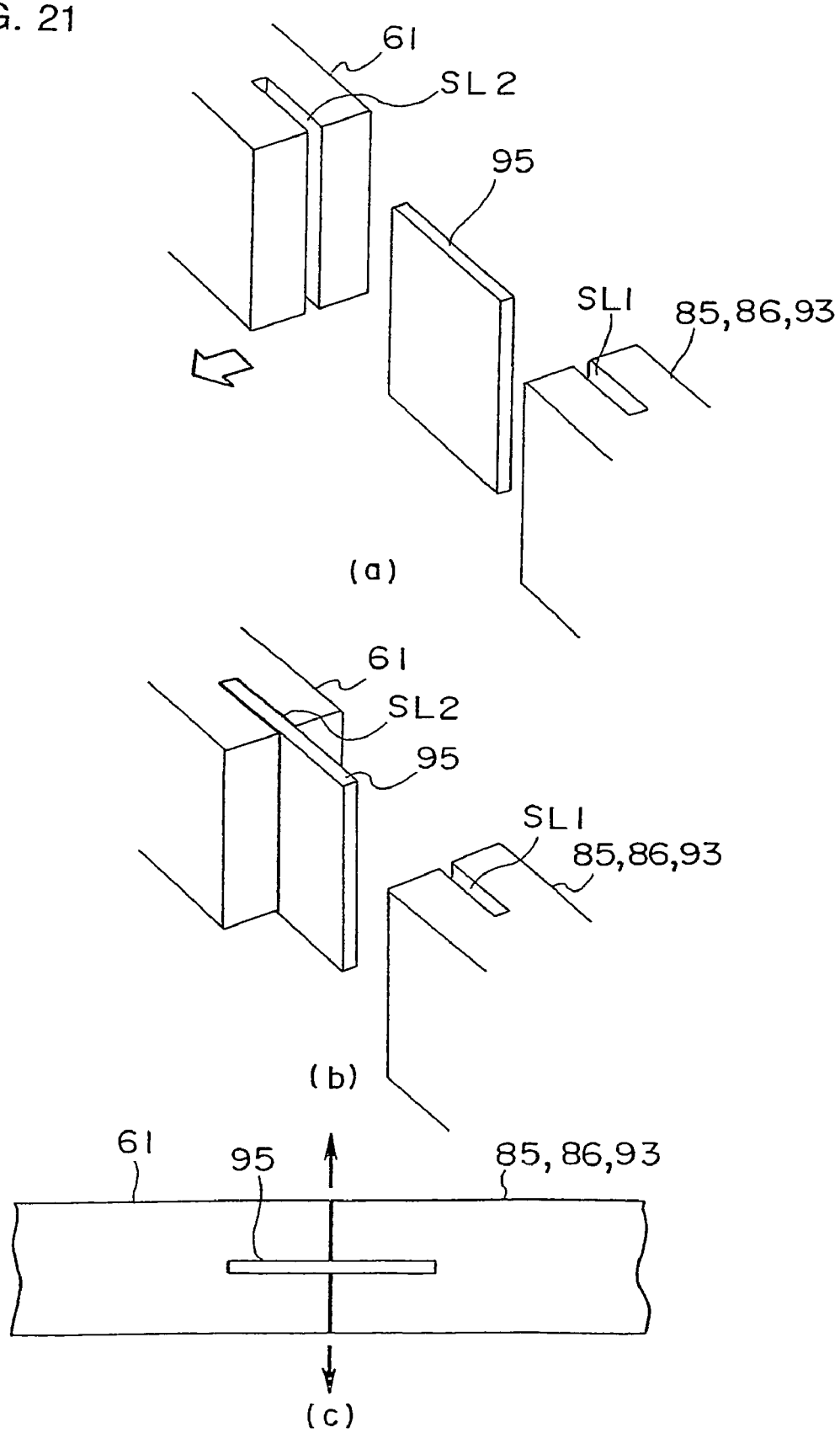
FIGS. 21(*a*) through 21(*c*) illustrate how structural members are interlocked.

The peripheral wall structural members 85 and 86 and the roof structural member 93 in FIGS. 18(*b*) and 18(*c*) may be connected with peripheral wall structural members 61 in the following manner. Namely, as shown in FIG. 21(*a*), a slit-like recessed portion SL1 is formed at an end surface of each of the peripheral wall structural members 85 and 86 and the roof structural member 93, and a slit-like recessed portion SL2 is formed at an end surface of a peripheral wall structural member 61 to face opposite the end surface of the peripheral wall structural member 85 or 86 or the roof structural member 93. Then, as shown in FIG. 21(*b*), part (approximately half) of a flat plate 95 is fitted in and bonded to one of the recessed portions, i.e., the recessed portion SL2, by leaving the remaining portion of the flat plate 95 projecting out beyond the end surface of the peripheral wall structural member 61. The projecting portion of the flat plate 95 is fitted in and bonded to the other recessed portion SL1. Thus, the peripheral wall structural member 85 or 86 or the roof structural member 93 is connected to the peripheral wall structural member 61 with the flat plate 95 clamped between them, as shown in FIG. 21(*c*). By connecting the structural members via the flat plate 95, as described above, the coupling force along the vertical direction (the direction indicated by the arrows in FIG. 21(*c*)) is increased. It is to be noted that the interlocking portions KG1 and KG2 where the peripheral wall structural members 81 through 86 are connected with each other and the roof structural members 91 through 93 respectively are connected with each other may adopt the structure shown in FIG. 21, as well.

Figure 22:
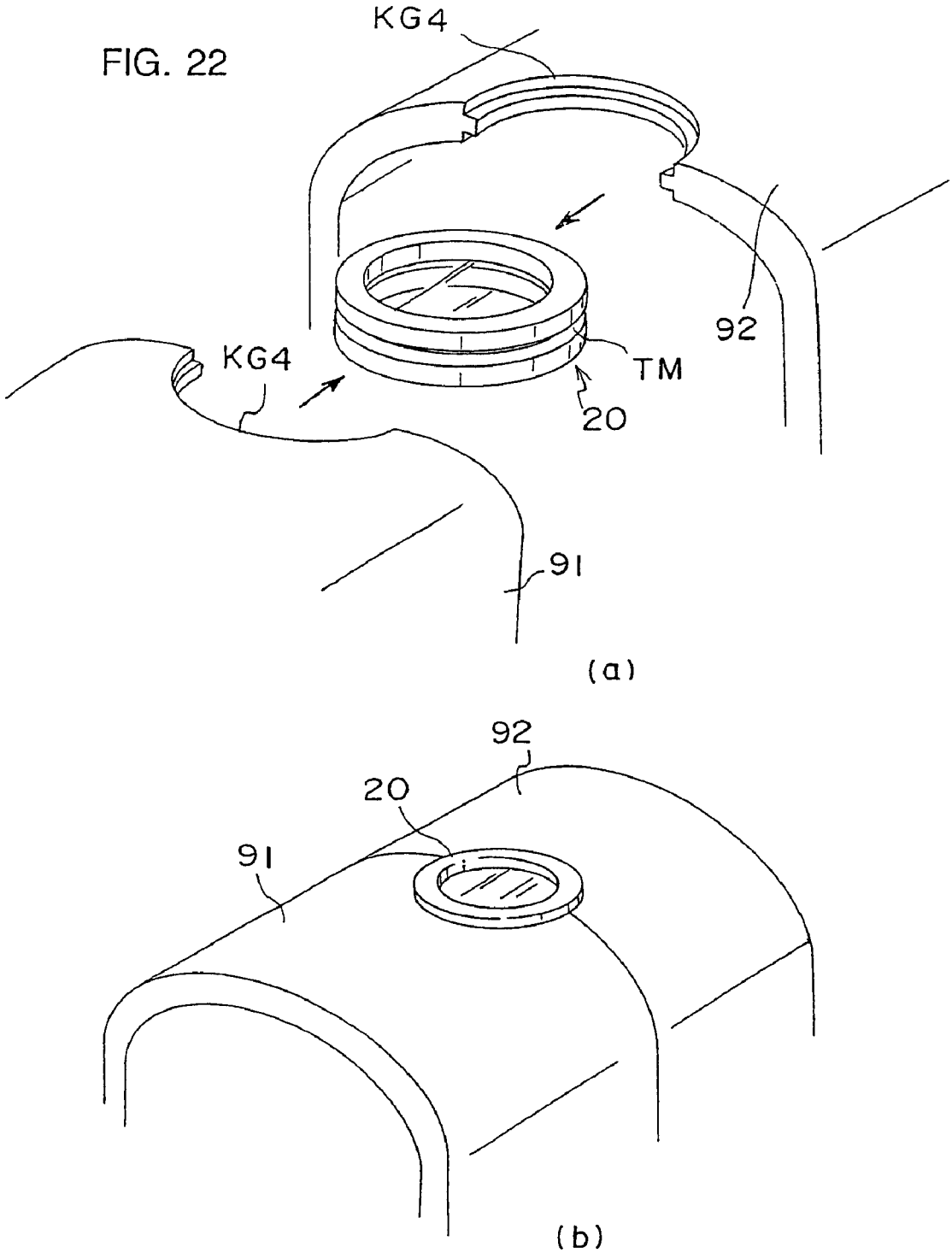
FIGS. 22(*a*) and 22(*b*) illustrate how a skylight frame may be mounted at roof structural members.

As shown in FIG. 22, a skylight frame 20 is disposed at the position at which the roof structural members 91 and 92 are interlocked with each other. The end surfaces of the roof structural members 91 and 92 are each notched in a semi-spherical shape and a projecting interlocking portion KG4, the shape of which corresponds to the shape of the recessed skylight portion TM is formed at each notched end surface, as shown in FIG. 22(*a*). Then, the projecting interlocking portions KG4 are fitted in and bonded to the recessed skylight portion TM and the skylight frame 20 is mounted between the roof structural members 91 and 92, as shown in FIG. 22(*b*). The skylight frame 20 prevents any displacement of the roof structural members 91 and 92 and also improves the strength.

Figure 23:
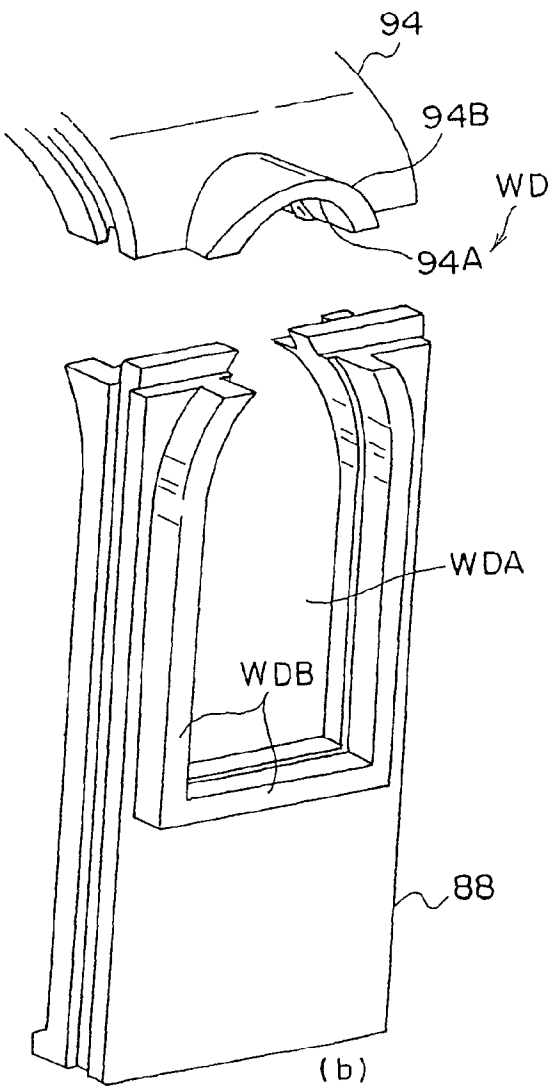
FIG. 23(*a*) shows an entry portion provided at a peripheral wall structural member and FIG. 23(*b*) shows a window portion provided at a peripheral wall structural member.
Figure 23:
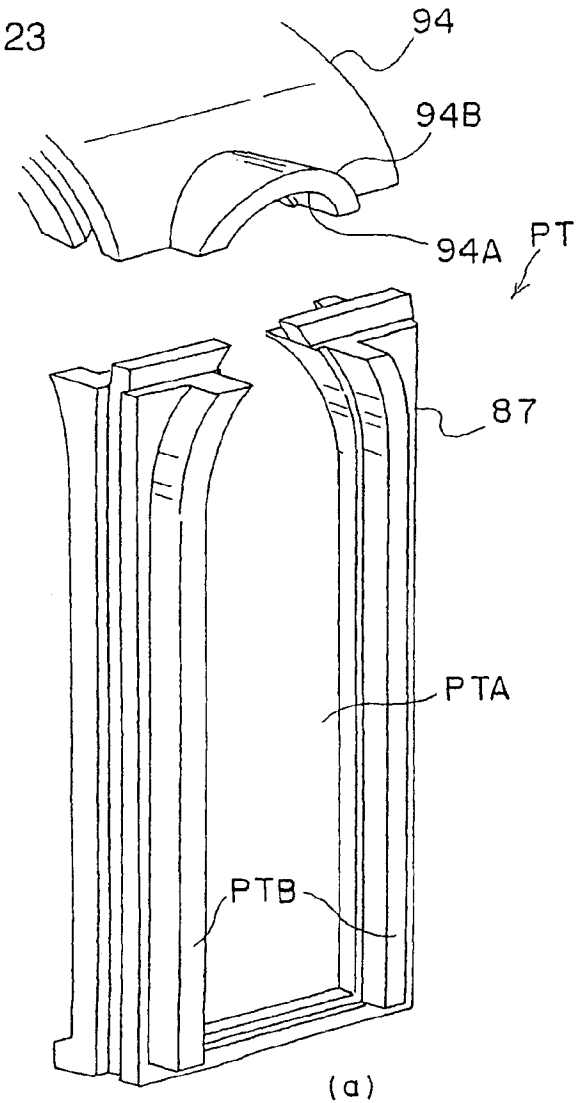
Figure 24:
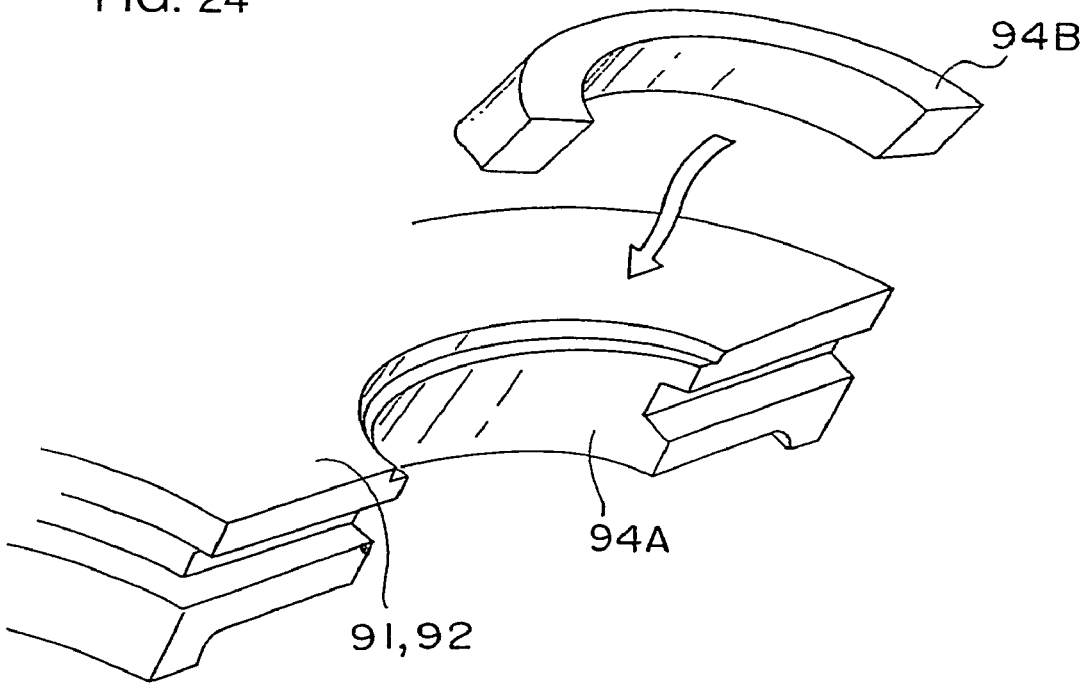
FIGS. 24(*a*) and 24(*b*) show a roof structural member used in conjunction with the entry portion and the window portion in FIG. 23.
Figure 24:
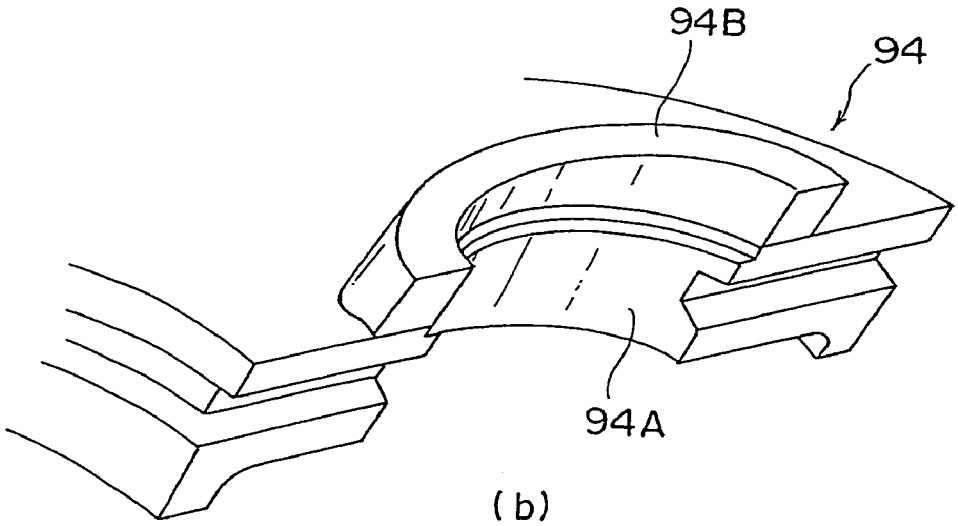

The entry portion PT and the window portion WD in the loaf-shaped house 300 may assume the structures shown in FIGS. 23(*a*) and 23(*b*) respectively. An opening PTA with an open upper end and an entrance frame PTB with an open upper end are formed at a peripheral wall structural member 87, whereas an opening WDA with an open upper end and a window frame WDB with an open upper end are formed at a peripheral wall structural member 88. Roof structural members 94 attached to the entry portion PT and the window portion WD are identical to each other and each includes a notched portion 94A to be set continuous to the opening PTA or WDA of the peripheral wall structural member 87 or 88 and a connecting frame 94B to be set continuous to the frame PTB or WDB. The peripheral wall structural members 87 and 88 can be formed by partially modifying the mold used to form the flat peripheral wall structural members 81 through 84 (see FIG. 16). The roof structural members 94, on the other hand, can each be formed by forming the notched portion 94A at the lower end surface of the roof structural member 91 or 92 (see FIG. 16) as shown in FIG. 24(*a*) and then bonding the connecting frame 94B onto the outer circumferential surface of the roof structural member, as shown in FIG. 24(*b*). Since common molds can be utilized, the production cost can be minimized.

The assembly procedure adopted in the third embodiment is basically similar to the assembly procedure adopted in the first embodiment. Namely, concrete slab PD is laid in a substantially rectangular shape to constitute the foundation 40 at a location where the prefabricated house 300 is to be built, the peripheral wall structural members 81 through 88 are set up and assembled on the foundation 40 via their base portions DB and then the peripheral wall structural members 81 through 88 are interlocked and bonded to each other, thereby forming the peripheral wall 80. The roof structural members 91 through 94 and the skylight frame 20 are assembled on the ground and are fitted with and bonded to each other, thereby forming the roof 90. The roof 90 is placed onto the peripheral wall 80, the peripheral wall 80 and the roof 90 are interlocked and bonded to each other, and thus, the house 300 is assembled. Then, resin primer and paint are applied to the interior and exterior surfaces of the house 300.

As described above, according to the present invention achieved in the third embodiment, in which a plurality of peripheral wall structural members 81 through 88 and a plurality of roof structural members 91 through 94 constituted of styrene foam are bonded together to form a loaf-shaped house 300, the size of the individual structural members can be reduced to achieve an improvement in the transportability. In particular, some of the peripheral wall structural members, i.e., the peripheral wall structural members 81 through 84, which are flat, can be loaded in a large quantity into a limited space available on the rear platform of a truck, for instance. Since a ribbed structure is adopted in the areas where the individual structural members are connected, the strength of the house is increased so as to achieve a sufficient level of withstanding performance against accumulated snow and the like. The positional arrangement of the entry portion PT and the window portion WD can be altered freely simply by modifying the combination of the peripheral wall structural members 81 through 88, and thus, houses adopting various layouts can be built with these.

-Variations-

Examples of variations of the third embodiment are explained in reference to FIGS. 25 through 34.

Figure 25:
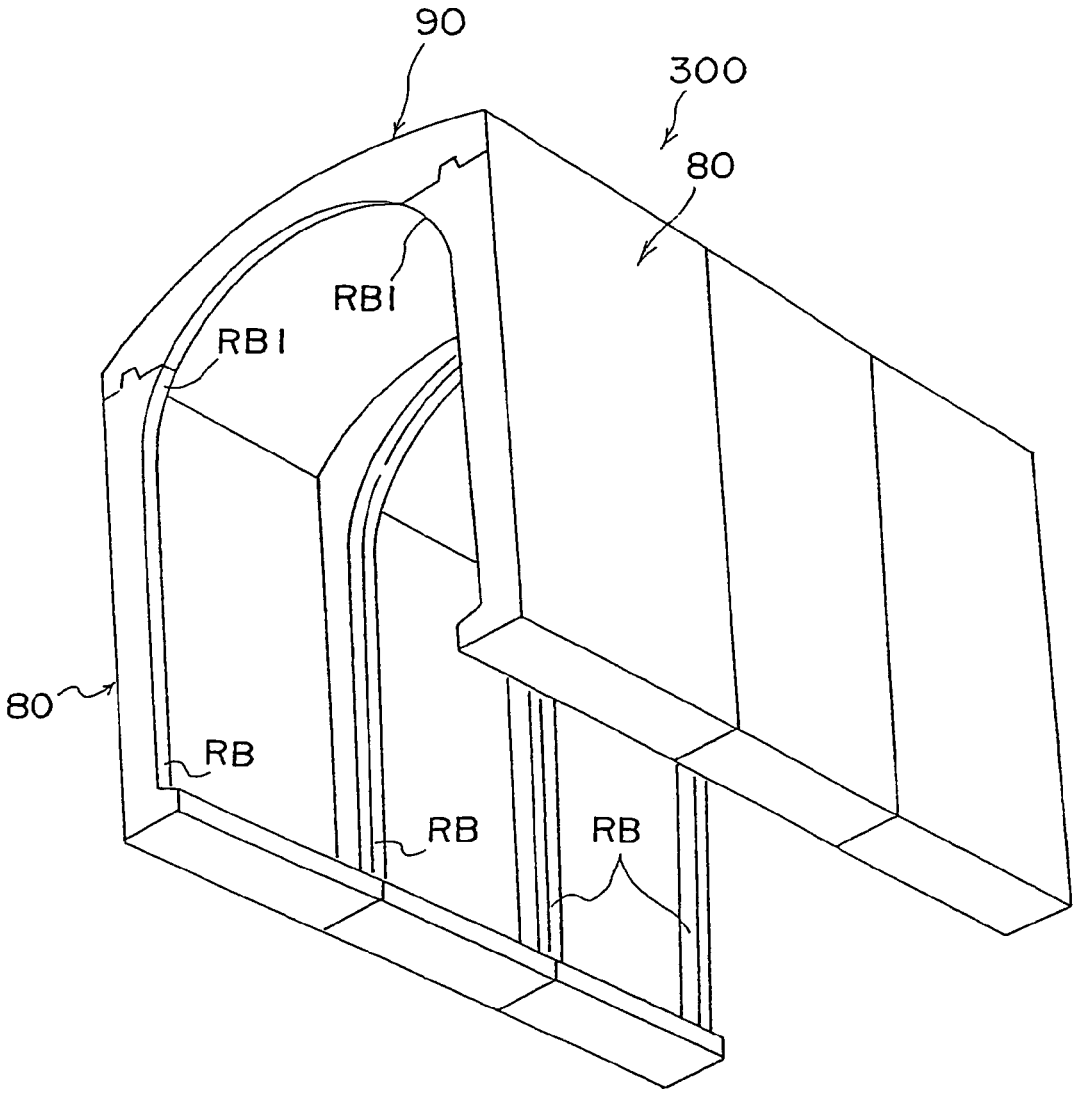
FIG. 25 is a perspective of a variation of FIG. 19.
Figure 26:
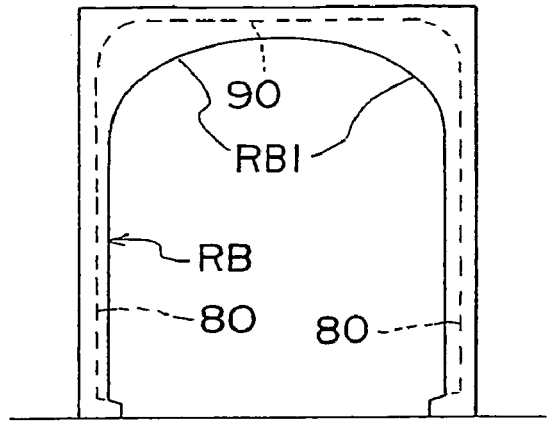
FIGS. 26(*a*) through 26(*c*) are each a front view of another variation that may be adopted in the ribbed structure.
Figure 26:
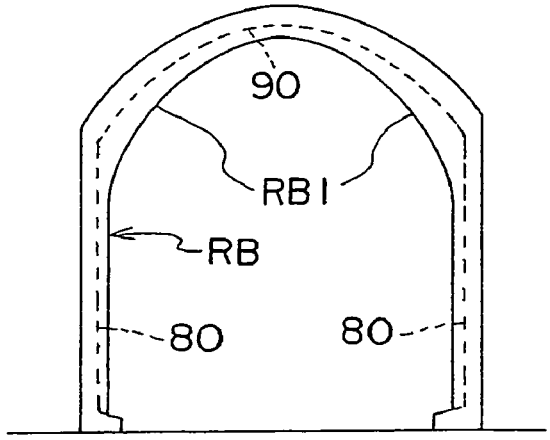
Figure 26:
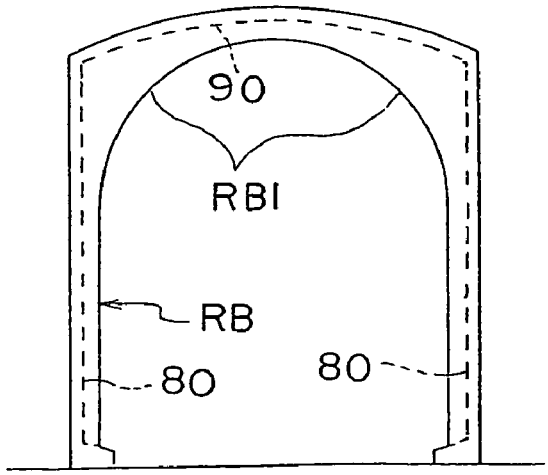

FIG. 25 shows a variation of the ribbed structure. In the ribbed structure shown in FIG. 25, a greater curvature is achieved at corners RB1 of the ribs RB, i.e., near the areas over which the peripheral wall 80 and the roof 90 are interlocked with each other. While the ribs RB need to project out into the interior space by a greater extent when the curvature of the ribs RB is large, the strength of the prefabricated house 300 can be further increased. In such a fabricated house, the shape of the ribs and in particular the shape of the ribs at their corners RB1 may be different from the contour of the interior surface of the house 300 (indicated by the dotted line), as shown in FIG. 26. It is to be noted that FIGS. 26(*a*) through 26(*c*) show roofs formed in different shapes, and ribs RB can be provided in conjunction with roofs assuming various shapes.

Figure 27:
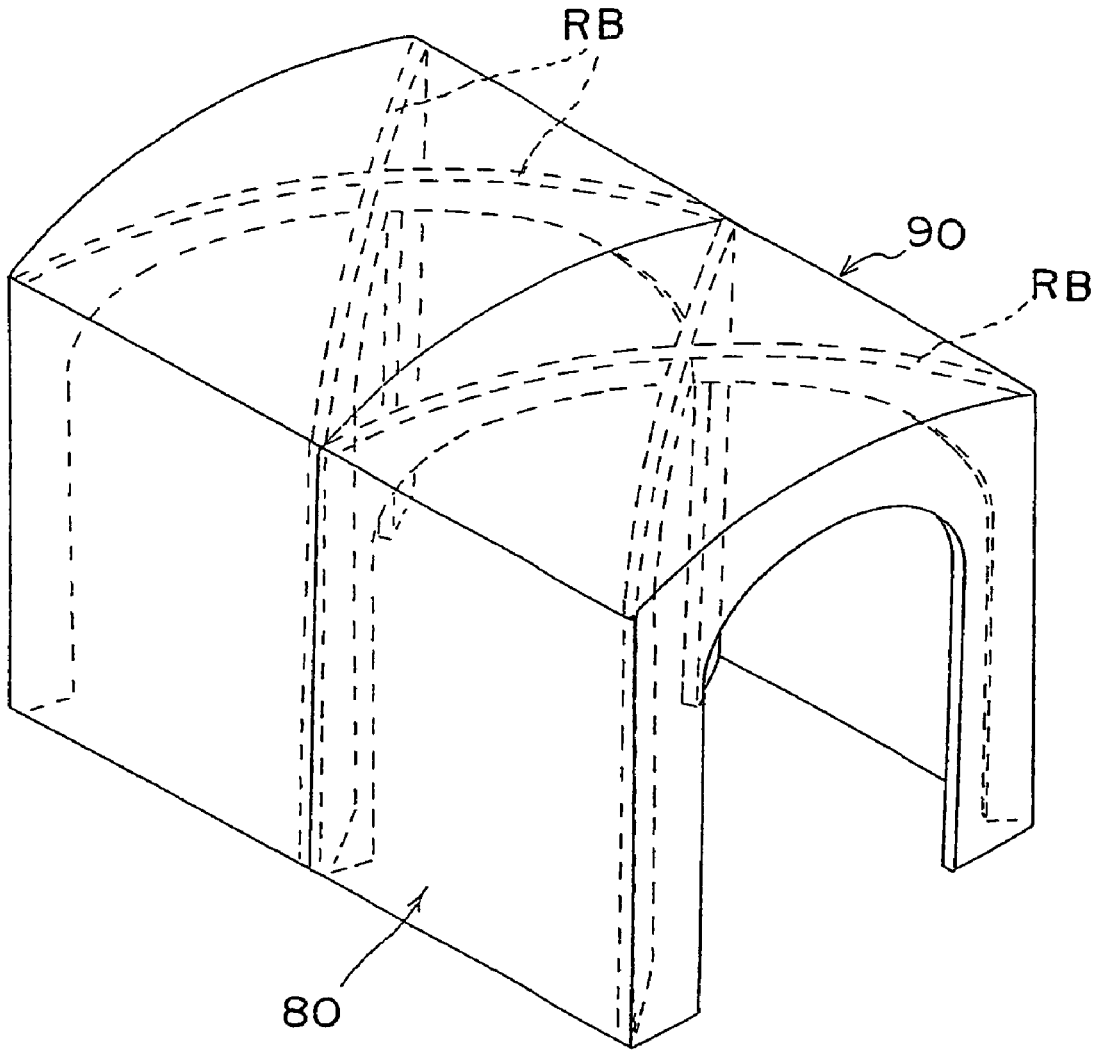
FIG. 27 is a perspective of yet another variation of the structure in FIG. 19.

Ribs RB may also be disposed at positions other than the interlocking positions at which the peripheral wall structural members 81 through 88 and the roof structural members 91 through 94 are interlocked with one another. For instance, ribs RB may be disposed so as to crisscross each other at the ceiling, as shown in FIG. 27.

Figure 28:
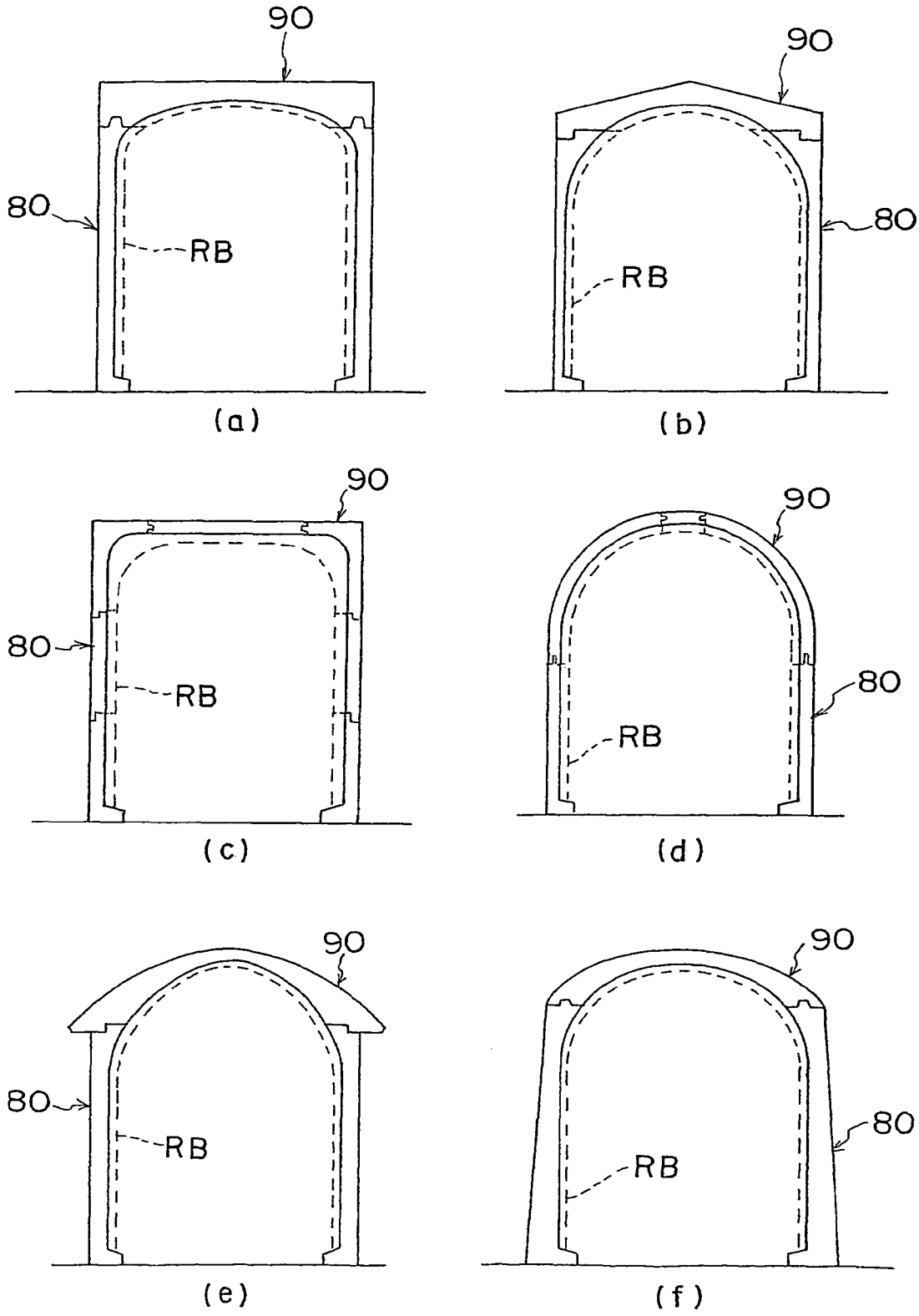
FIGS. 28(*a*) through 28(*f*) are each a front view of a variation of the peripheral wall structural members and the roof structural members achieved in the third embodiment.

The peripheral wall 80 and the roof 90 may adopt any of the shapes shown in FIG. 28. It is to be noted that the shape of the ribs are indicated by the dotted lines in FIG. 28. In FIG. 28(*a*), the roof 90 has a flat top, whereas the roof has a peaked shape in FIG. 28(*b*). FIG. 28(*c*) shows the peripheral wall 80, which includes peripheral wall structural members each further divided into smaller portions along the lengthwise (vertical) direction and the roof 90, which includes roof structural members each further divided into smaller portions along the widthwise direction. FIG. 28(*d*) shows the roof 90 formed in a semicircular shape which includes roof structural members each further divided into smaller portions along the widthwise direction. FIG. 28(*e*) shows the roof 90 having the lower end thereof projecting further out beyond the exterior surface of the peripheral wall 80. The wall thickness of the peripheral wall 80 in FIG. 28(*f*) is increasing toward the bottom from the top.

Figure 29:
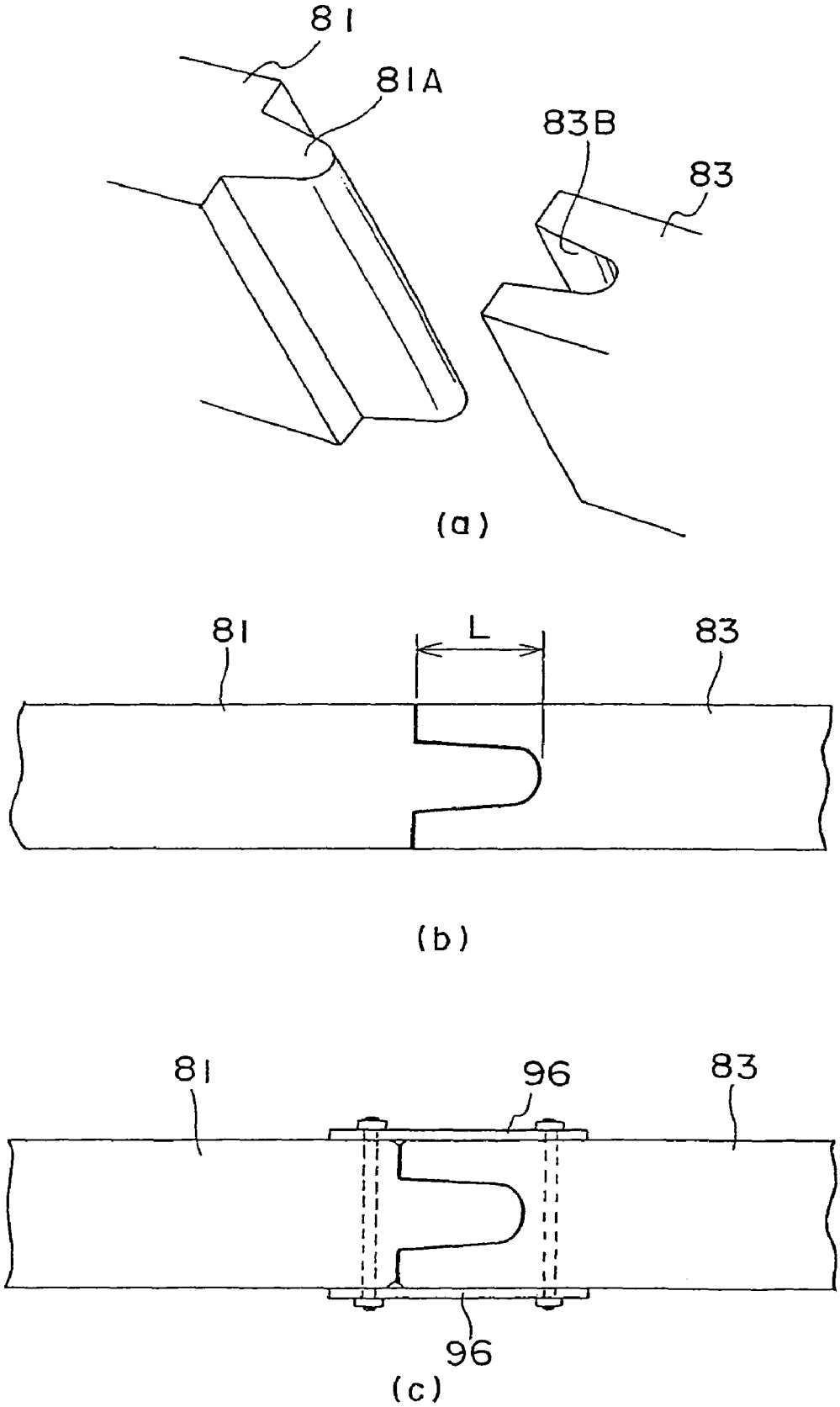
FIGS. 29(*a*) through 29(*c*) show a variation of the structure in FIG. 21.
Figure 30:
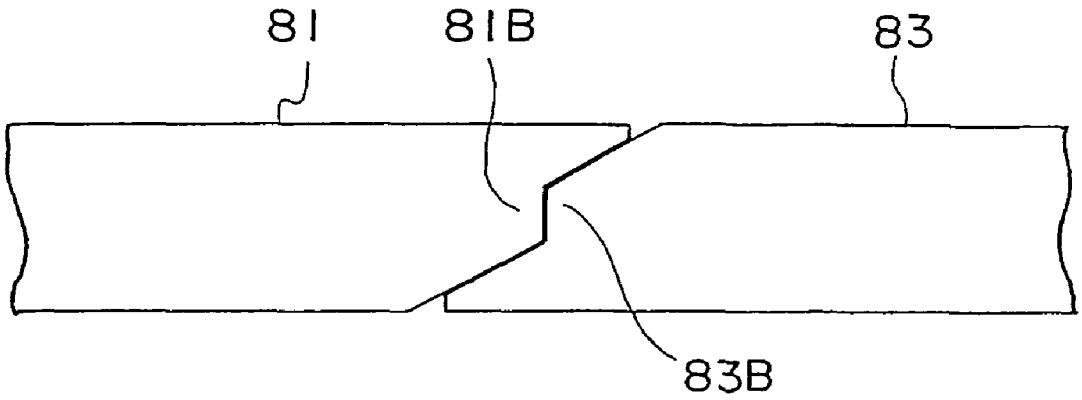
FIGS. 30(*a*) and 30(*b*) show another variation of the structure in FIG. 21.
Figure 30:
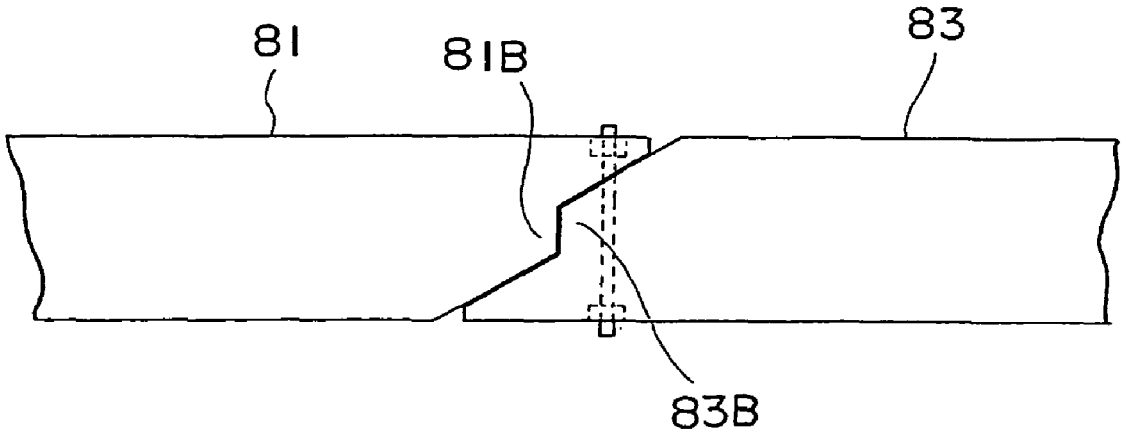

An example of a variation that may be adopted in the interlocking portions of the structural members 81 through 88 and 91 through 94 is shown in FIG. 29. In this variation, a substantially U-shaped projecting portion 81A is formed at an end surface of a structural member (e.g., the peripheral wall structural member 81) and a recessed portion 83A is formed at an end surface of another structural member (e.g., the peripheral wall structural member 83) adjacent to the first structural member, as shown in FIG. 29(*a*). The projecting portion 81A is fitted in and bonded to the recessed portion 83A, as shown in FIG. 29(*b*), thereby connecting the structural members to each other. When structural members are coupled in this manner, a higher level of strength is achieved by allowing for a greater length L over which the structural members are fitted with each other. By placing plates 96 over the surfaces of the fitting portions on both sides and tightening the fitting portions with bolts, as shown in FIG. 29(*c*), the structural members can be coupled with an even higher level of strength. Alternatively, staged portions 81B and 83B may be respectively formed at end surfaces of the structural members 81 and 83, as shown in FIG. 30(*a*) to engage the structural members to each other via the staged portions 81B and 83B. By fastening the staged portions 81B and 83B with a bolt, as shown in FIG. 30(*b*), the structural members can be coupled firmly without having to use any plates 96.

Figure 31:
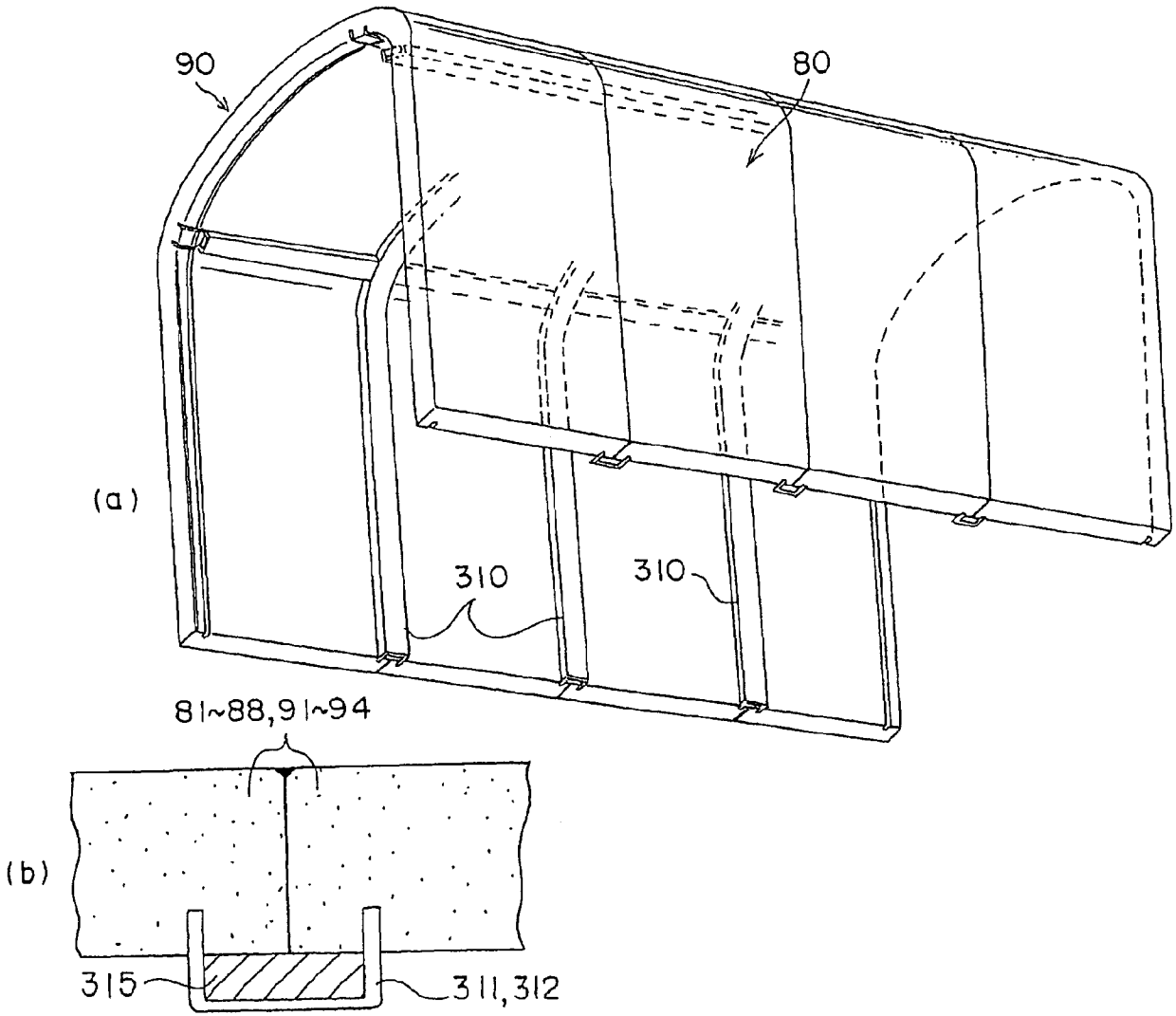
FIGS. 31(*a*) and 31(*b*) show a structure having a steel frame inside the prefabricated styrene foam house in the third embodiment.
Figure 32:
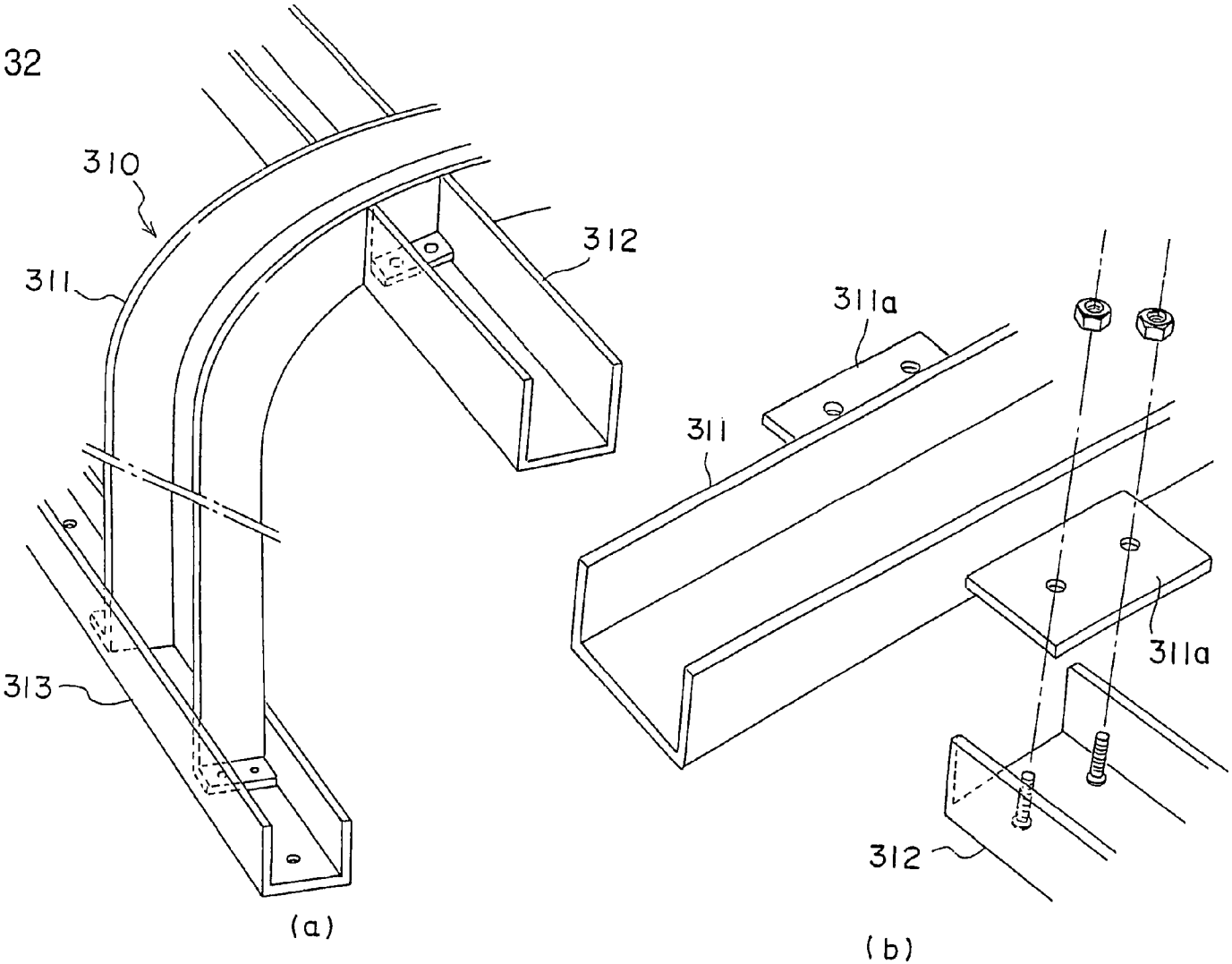
FIGS. 32(*a*) and 32(*b*) are perspectives of the steel frame in FIG. 31.
Figure 33:
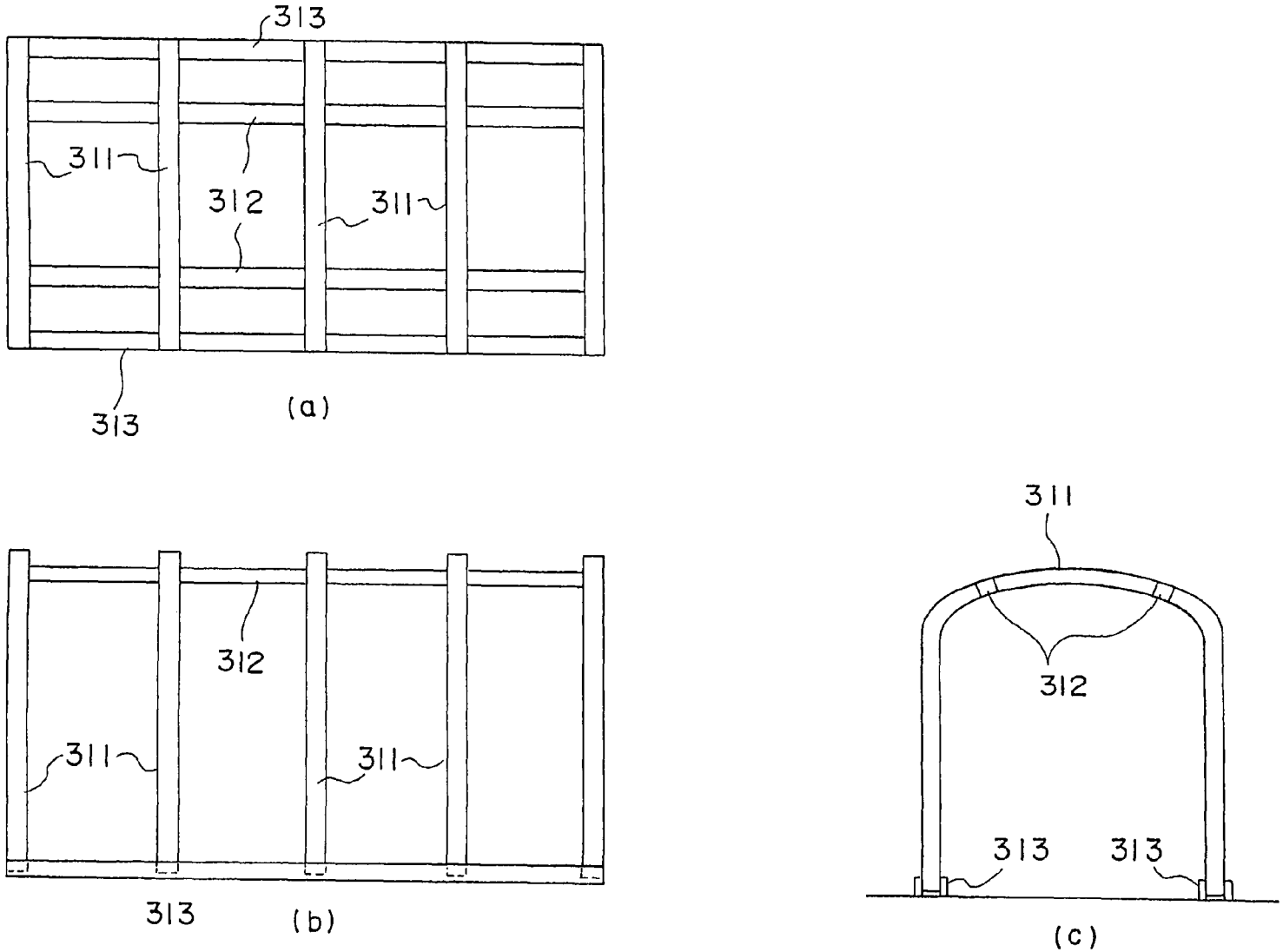
FIG. 33(*a*), FIG. 33(*b*) and FIG. 33(*c*) are respectively a top view, a side elevation and a front view of the steel frame in FIG. 31.

As shown in FIG. 31(*a*), a steel frame 310 may be disposed over the interlocking portions of the peripheral wall structural members 81 through 88 and the roof structural members 91 through 94. FIG. 32(*a*) is a perspective showing the structure adopted in the steel frame 310, with FIGS. 33(*a*) through 33(*c*) respectively presenting a top view, a side elevation and a front view of the steel frame. The steel frame 310 includes substantially U-shaped arched portions 311 each connecting peripheral wall structural members to adjacent peripheral wall structural members and a roof structural member to another roof structural member, roof portions 312 connecting the peripheral wall structural members 81 through 88 to the corresponding roof structural members 91 through 94 and base portions 313. The arched portions 311, the roof portions 312 and the base portions 313 are each constituted with a C-type steel having a substantially angular U-shaped section.

The recessed grooves of the C-type steel constituting the arched portions 311 and the roof portions 312 are both set toward the outside. As shown in FIG. 32(*b*), brackets 311*a* are provided at each arched portion 311, and the arched portion 311 is coupled with a roof portion 312 at right angles by tightening bolts via a bracket 311(*a*). The recessed grooves of the C-type steel constituting the base portions 313 are set facing upward. The bottoms of the arched portions 311 are fitted inside these recessed grooves and the arched portions and the base portions are coupled with each other at right angles by tightening bolts. As shown in FIG. 31(*b*), a foam part 315 is embedded through monolithic forming at the recessed grooves of the C-type steel constituting the arched portions 311 and the roof portions 312.

The house that includes the steel frame may be assembled through the procedure described below. First, the base portions 313 are fixed onto the ground by using anchor bolts or the like, and then the arched portions 311 are connected to the base portions 313. During this process, the bottoms of the arched portions 311 are fitted and positioned inside the base portions 313 and thus, they can be coupled with ease. Next, the roof portions 312 are connected to the arched portions 311, thereby completing assembly of the steel frame 310. Subsequently, the peripheral wall structural members 81 through 88 and the roof structural members 91 through 94 are inserted from the outside of the arched portions 311 and the roof portions 312 until they come into contact with the foam parts 315 and then the inserted structural members are bonded. Since the extent to which the structural members 81 through 88 and 91 through 94 are allowed to advance inward is restricted by the foam parts 315, they are not allowed to move too far in to assure a satisfactory level of strength in the connecting areas.

Members of the steel frame 310 disposed on the inside of the house in this manner function as strengthening members and thus, the ribs RB are no longer required. Since C-type steel is used to constitute the steel frame members, the steel frame can be set more inside of the house compared to, for instance, a frame constituted with H-shaped steel. As a result, the difference between the temperature of the steel frame 310 on the indoor-side and the temperature of the steel frames 310 on the outdoor-side is minimized, to inhibit condensation. Since the recessed grooves of the C-type steel are set facing outward, entry of rainwater into the interior space via the joints between the structural members 81 through 88 and 91 through 94 is prevented.

Figure 34:
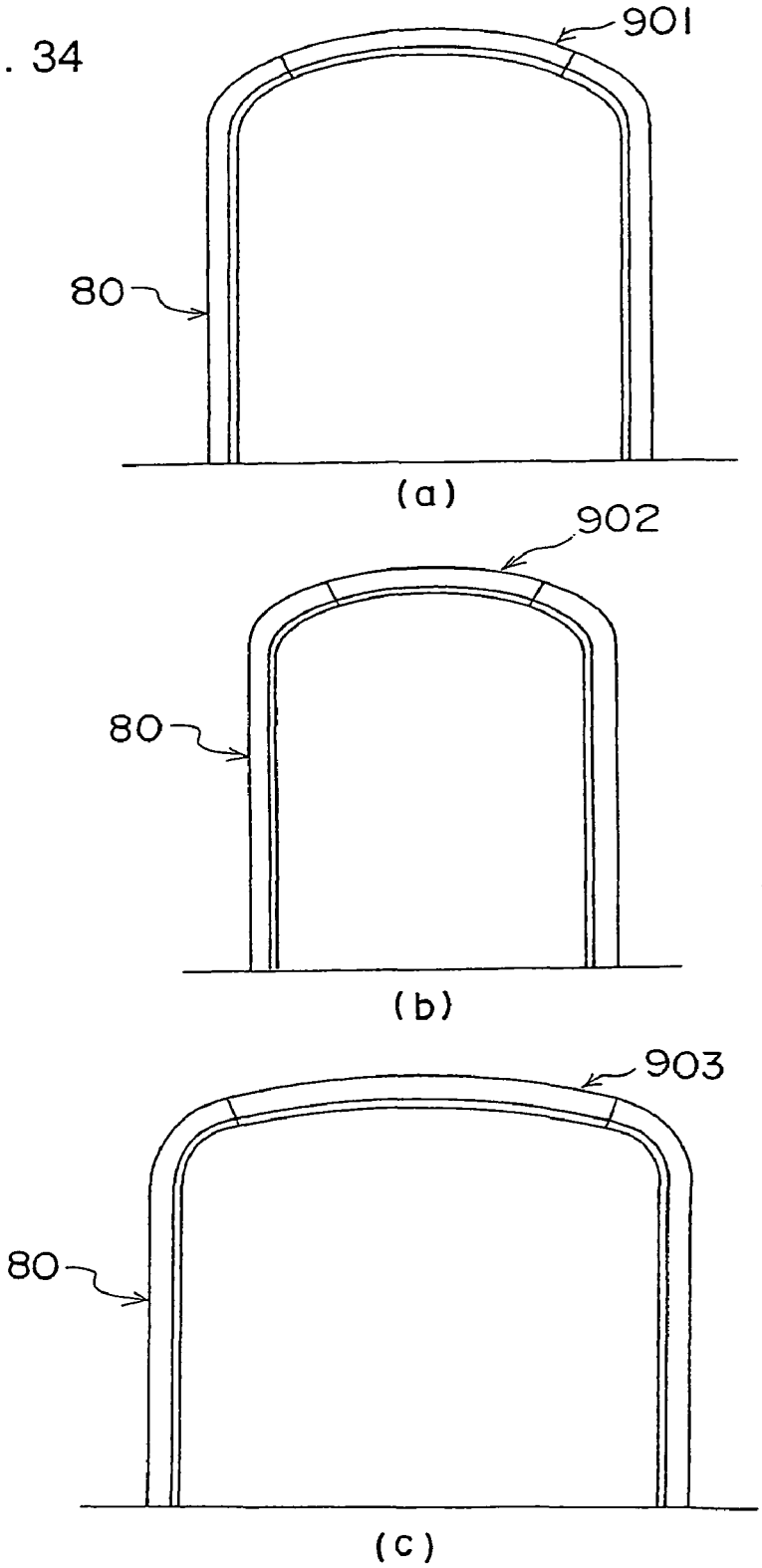
FIGS. 34(*a*) through 34(*c*) each show a variation of the roof structural members achieved in the third embodiment.

The assembled roof 90 may assume various shapes, as shown in FIGS. 34(*a*) through 34(*c*). An assembled roof 901 in FIG. 34(*a*) is a standard size roof, an assembled roof 902 in FIG. 34(*b*) is smaller than the assembled roof 901 and an assembled roof 903 in FIG. 34(*c*) is larger than the assembled roof 901. This means that in conjunction with the common peripheral wall 80, houses in varying sizes can be built with ease simply by altering the size of the assembled roof 90.

The present invention further allows for the following variations.

Figure 35:
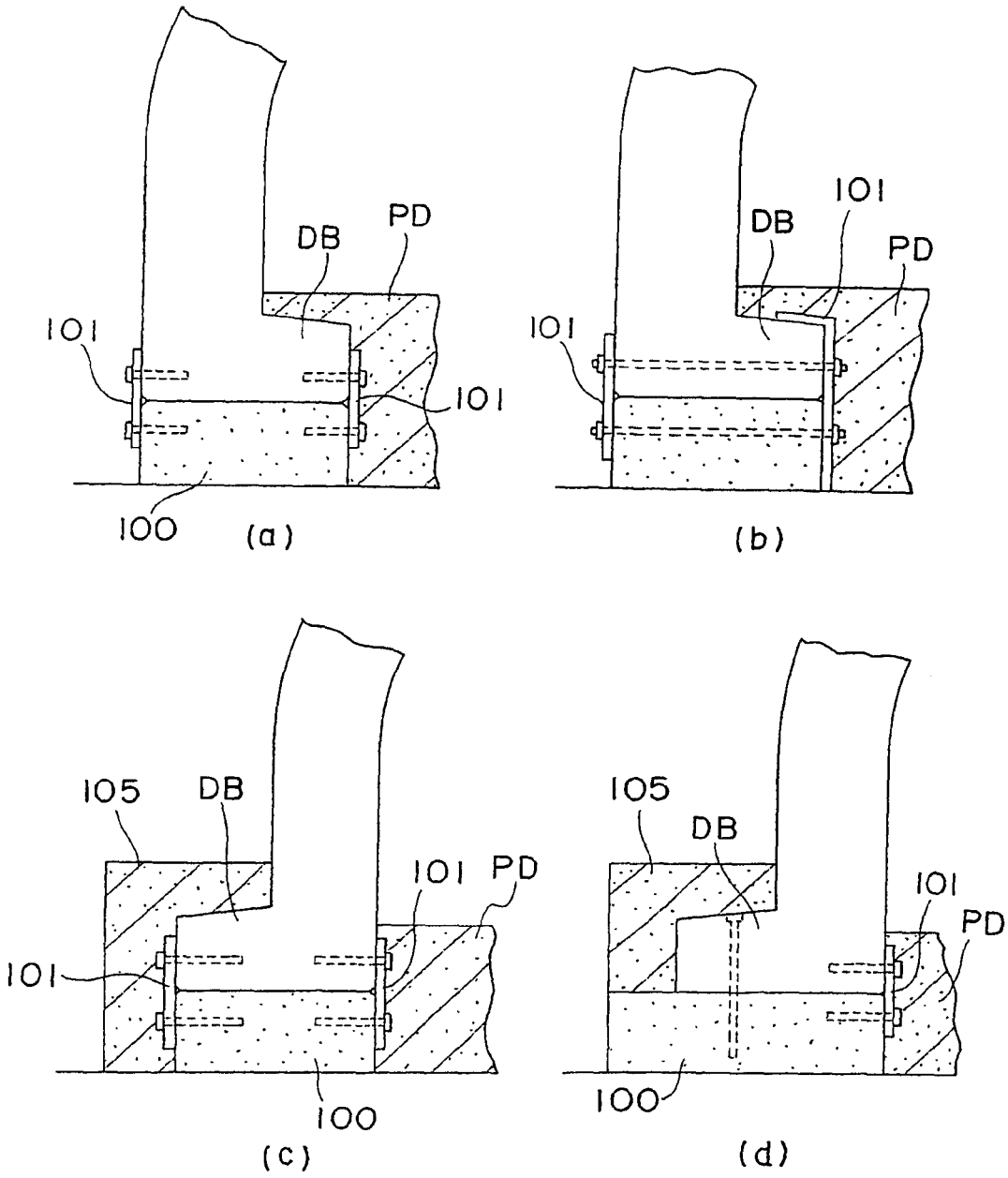
FIGS. 35(*a*) through 35(*d*) each show a variation of the structure in FIG. 7.

FIG. 35 presents examples of variations of the foundation 40 of the prefabricated house. A concrete block 100 is placed under each of the peripheral wall structural members 11 through 19, 61 through 69 or 81 through 88 constituted of styrene foam in the example of shown in FIG. 35(*a*). Plates 101 are fastened on with bolts over the end surfaces of the base portion DB of the peripheral wall structural member and the block 100 both on the interior side and on the exterior side and thus, the peripheral wall structural member and the block 100 are coupled as one via the plates 101. Subsequently, the concrete slab PD is laid on the interior side of the peripheral wall structural members. Since the concrete slab PD and the block 100 are coupled with a high level of coupling force, the peripheral wall structural members can be firmly fixed onto the concrete slab PD. In the example presented in FIG. 35(*b*), the plate disposed on the interior side is formed in an L-shape so as to hook the upper end of the plate onto the base portion DB and the plates 101 are fastened onto the base portion DB and the block 100 via through bolts.

FIG. 35(*c*) shows the base portion DB of the peripheral wall structural member formed to face outward and concrete 105 laid from the outside of the peripheral wall structural member so as to cover the base portion DB and the concrete block 100. The concrete 105 is set inside a mold and it has an L-shaped section in the figure. By forming the base portions DB of the peripheral wall structural members so as to face outward, the height of the concrete slab PD inside the house can be reduced and the floor surface can be set at a lower level.

In the example shown in FIG. 35(*d*), the base portion DB and the block 100 are fastened to each other with bolts via a single plate 101 disposed on the interior side, and they are fastened with a bolt along the vertical direction on the exterior side without using a plate 101. The block 100 extends further outside beyond the base portion DB of the peripheral wall structural member, with the concrete 105 laid to cover the base portion DB from the staged area formed with the block 100 and the base portion DB.

Figure 36:
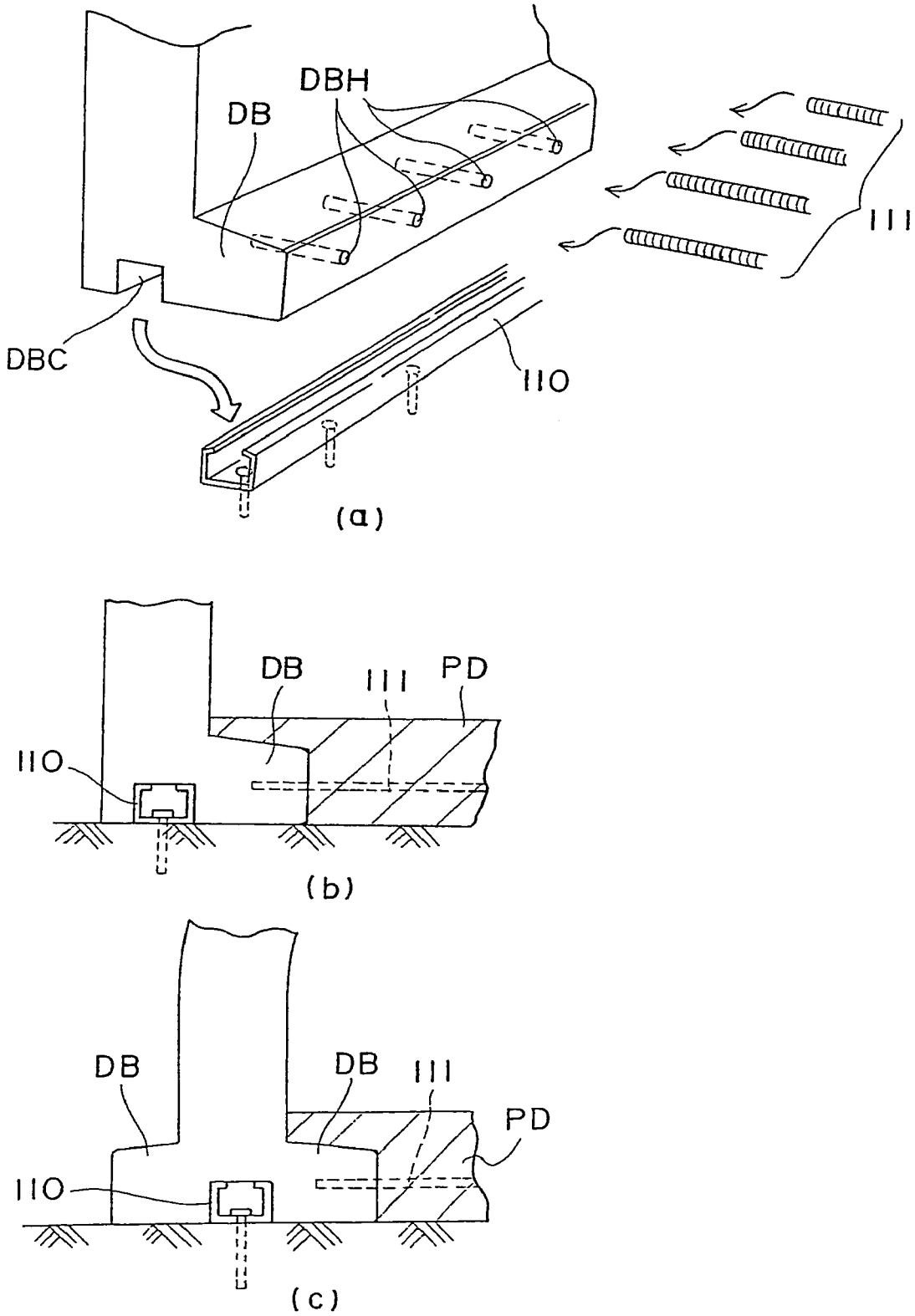
FIGS. 36(*a*) through 36(*c*) each show yet another variation of the structure in FIG. 7.

Other examples of the foundation 40 are shown in FIG. 36. FIG. 36(*a*) shows C-type steel 110 fixed via bolts at a position where a peripheral wall structural member is to be set. A recessed portion DBC is formed at the lower end surface of the peripheral wall structural member, this recessed portion DBC is fitted over the C-type steel 110 and thus, the position of the peripheral wall structural member along the horizontal direction is determined. A plurality of holes DBH are formed at the end surface of the base portion DB on the interior side, and reinforcing bars 111 are inserted at these holes DBH to position the peripheral wall structural member along the heightwise direction. In this state, concrete PD is set on the inside of the base portion DB, as shown in FIG. 36(*b*). By adopting this method, the peripheral wall structural member can be fixed firmly without using a block 100. FIG. 36(*c*) shows an example in which the base portion DB of the peripheral wall structural member is formed to distend toward the interior side and toward the exterior side. It is to be noted that instead of the C-type steel 110, square steel pipe may be used. As long as the bottom surface of the peripheral wall structural member can be interlocked at a positioning member such as the C-type steel 110, the structure of the interlocking portion formed at the bottom surface of the peripheral wall structural member and the shape of the positioning member are not limited to those explained in reference to the examples.

Figure 37:
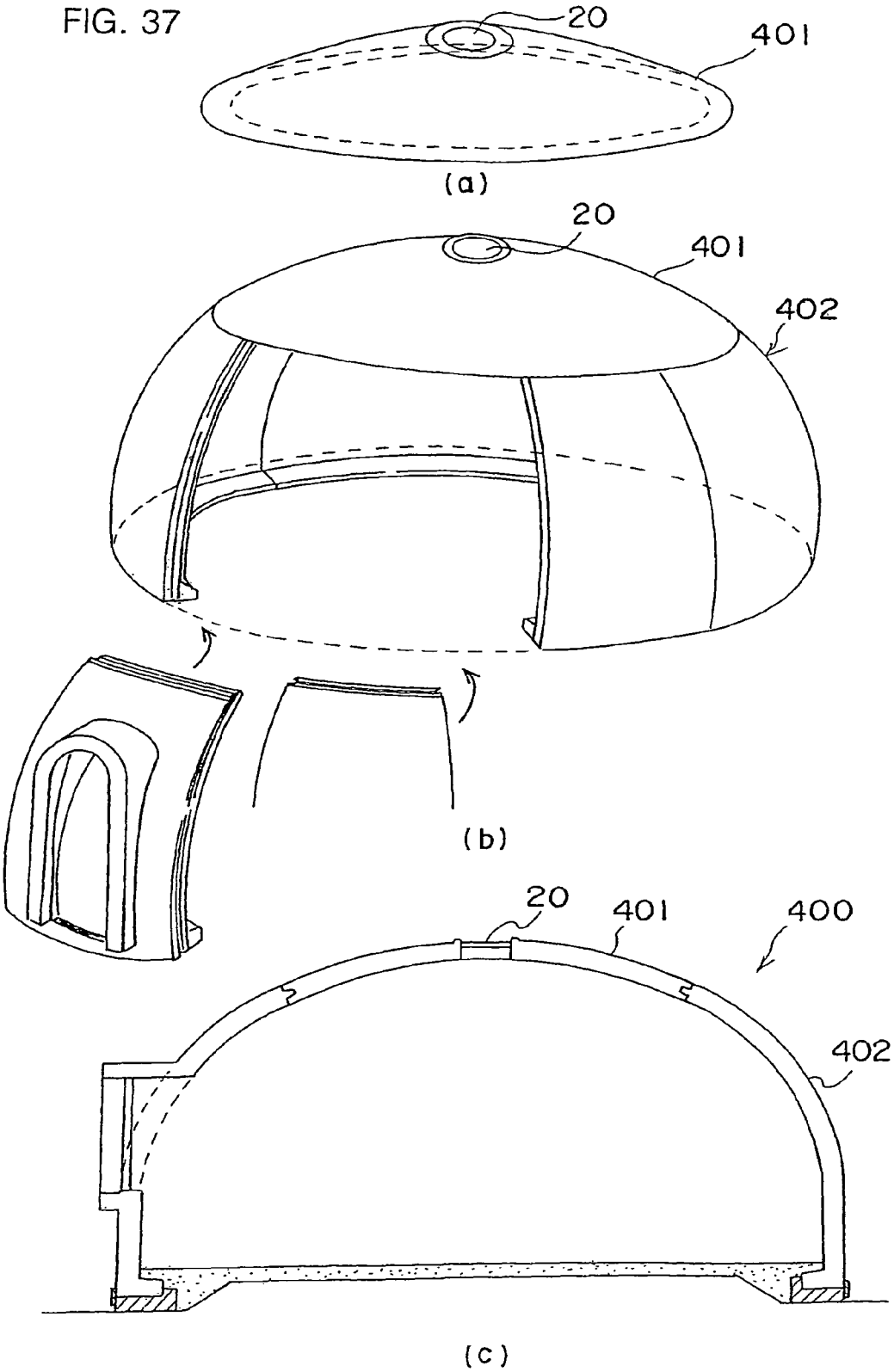
FIGS. 37(*a*) through 37(*c*) show a variation of the prefabricated styrene foam house according to the present invention.

In a prefabricated styrene foam house 400 shown in FIG. 37, only the peripheral wall is formed by assembling separate peripheral wall structural members. Namely, a roof 401 having a skylight 20 is formed with a single piece, as shown in FIG. 37(*a*), and the roof 401 is set on top of an assembled peripheral wall 402, as shown in FIG. 37(*b*). The assembled peripheral wall 402 and the roof 401 may interlock with each other at the recessed and projected portions formed thereat as shown in FIG. 37(*c*). By forming the roof 401 with a single piece, the ease of assembly is improved. The size of the roof 401 is not much larger than the size of the peripheral wall structural members 402 and thus, fairly good transportability is assured.

Figure 38:
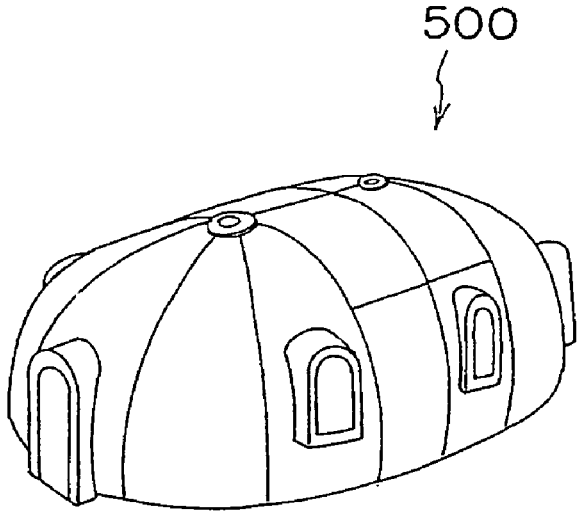
FIGS. 38(*a*) and 38(*b*) are perspectives of another variation of the prefabricated styrene foam house according to the present invention.
Figure 38:
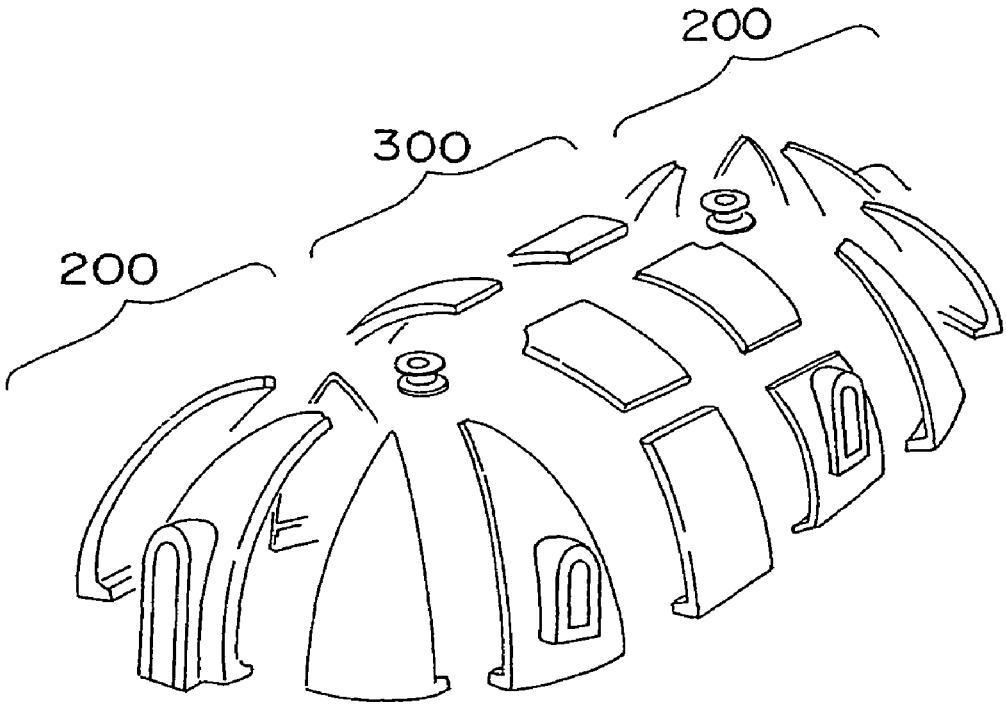
Figure 39:
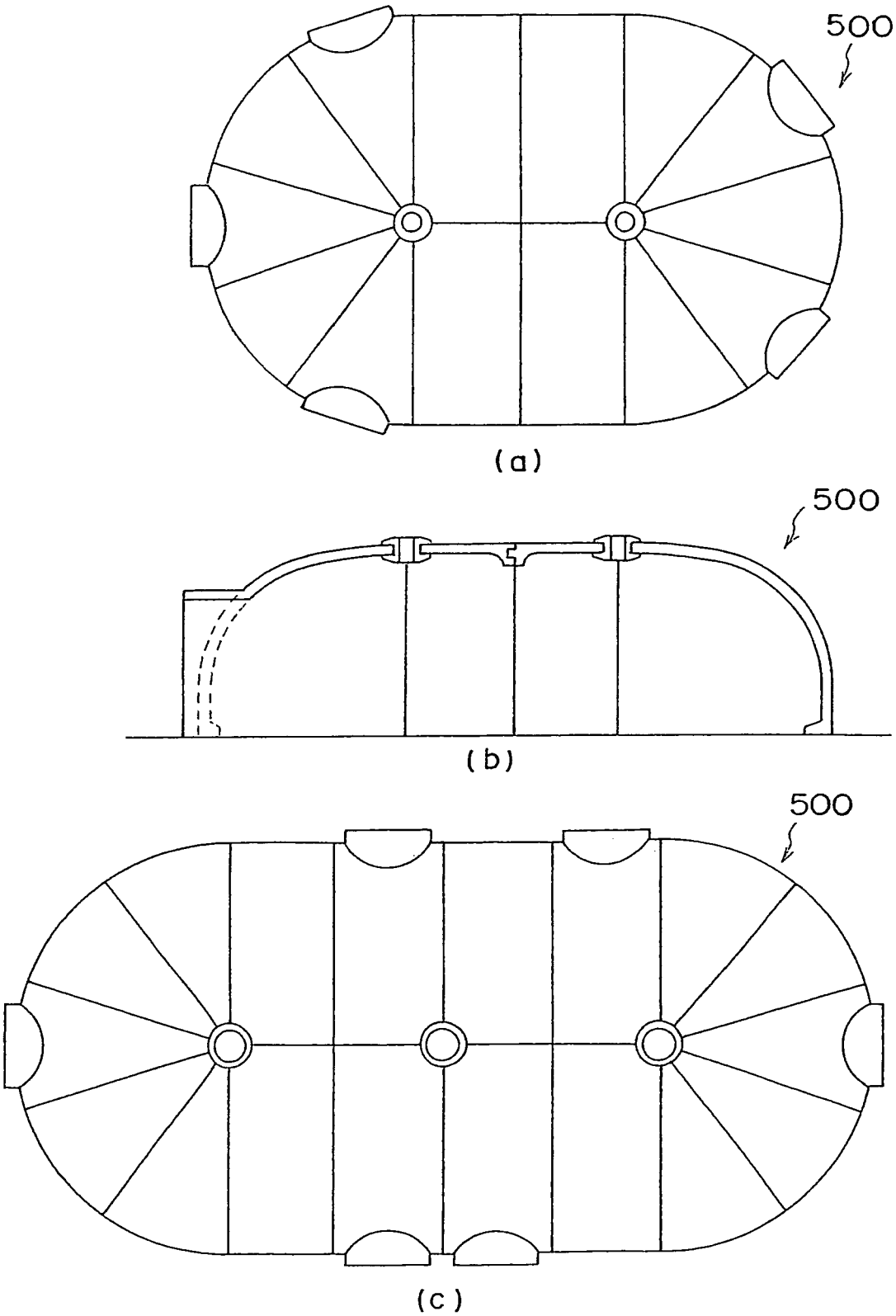
FIG. 39(*a*) and FIG. 39(*b*) are respectively a plan view and a sectional view of the prefabricated styrene foam house in FIG. 38 and FIG. 39(*c*) is a plan view of a variation of FIG. 39(*a*)

The shapes of prefabricated houses are not limited to those explained in reference to the embodiments above. For instance, an egg-shaped prefabricated house 500 shown in FIG. 38(*a*) can be formed by combining structural members used to form the dome-shaped prefabricated house 200 and structural members used to form the loaf-shaped prefabricated house 300, as shown in FIG. 38(*b*). FIGS. 39(*a*) and 39(*b*) are respectively a plan view and a sectional view of the prefabricated house 500 shown in FIG. 38(*a*). It is to be noted that the house 500 can be further expanded, as shown in FIG. 39(*c*) by increasing the number of structural members in the loaf-shaped house 300.

Figure 40:
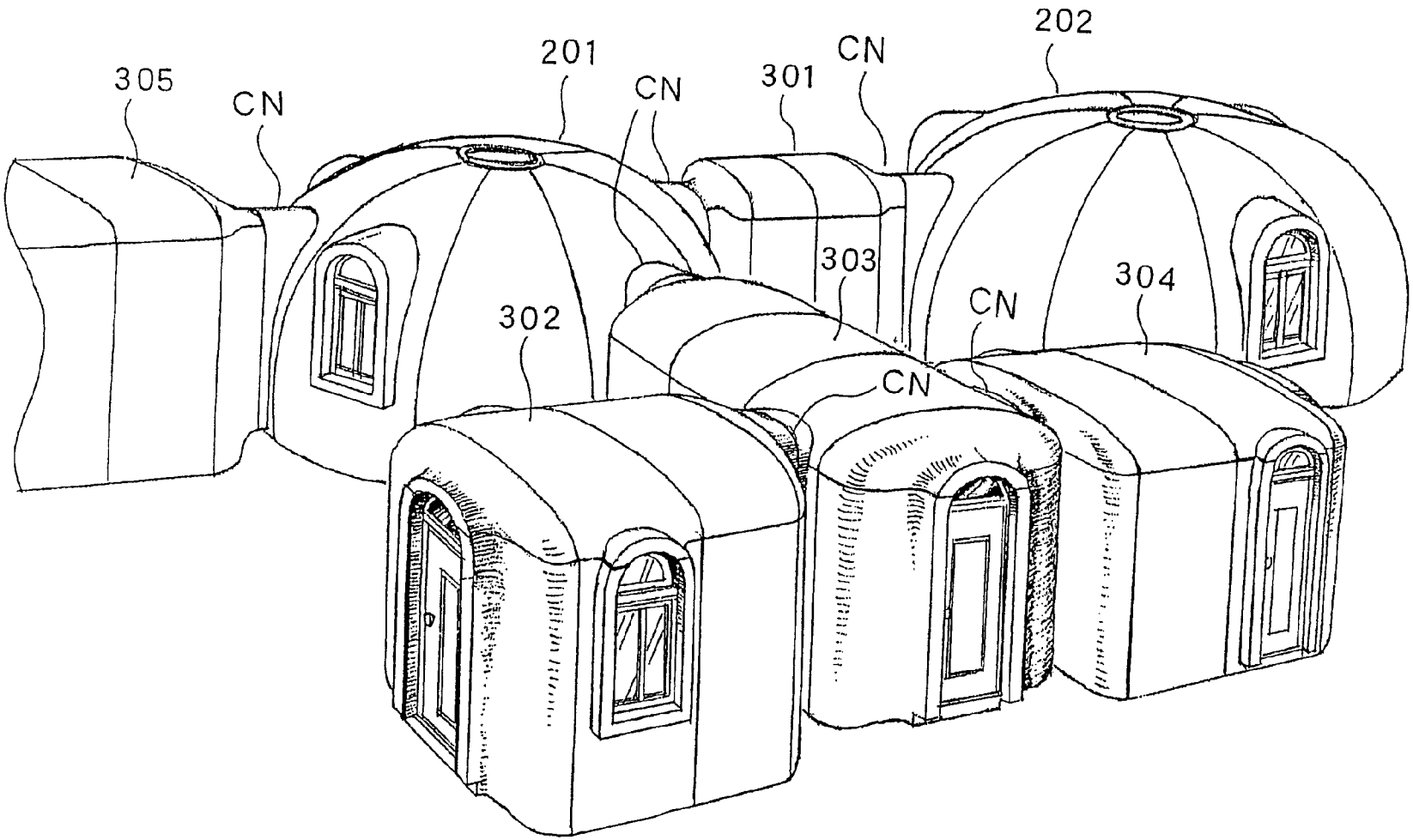
FIG. 40 is a perspective of a structure achieved by connecting a plurality of prefabricated houses according to the present invention.
Figure 41:
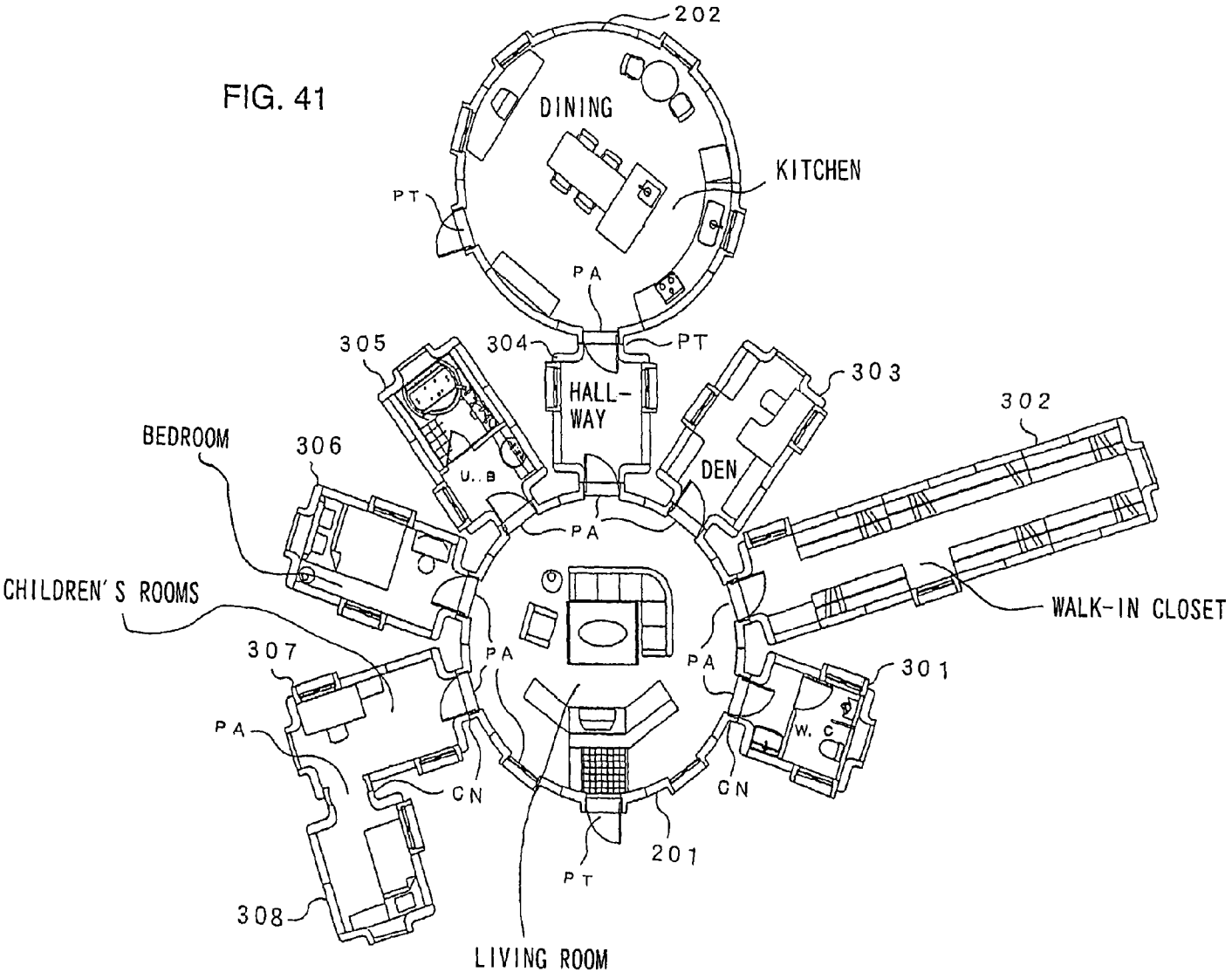
FIG. 41 shows the interior lay-out of the structure achieved by connecting a plurality of prefabricated houses.

The preassembled resin house according to the present invention achieves a high level of expandability. While FIG. 17 shows an example in which the cylindrical or semispherical house 100 or 200 is connected with the loaf-shaped house 300, a greater number of prefabricated houses 201, 202 and 301 through 305 may be connected, as shown in FIG. 40. By adopting such a configuration, a house with various types of rooms can be built with ease without increasing the size of each fabricated house unit. FIG. 41 presents an example of a room layout that may be adopted. FIG. 41 shows a living room 201 and a dining kitchen 202 each formed by using a semispherical prefabricated house unit, and a toilet 301, a walk-in closet 302, a den 303, a hallway 304, a bathroom 305, a bedroom 306 and children's rooms 307 and 308 each formed by using a loaf-shaped house unit. The toilet 301, the walk-in closet 302, the den 303, the hallway 304, the bathroom 305, the bedroom 306 and the children's rooms 307 and 308 are connected so as to surround the living room 201, with the dining kitchen 202 connected on the other side of the hallway 301.

It is to be noted that prefabricated houses may be connected in configurations other than those described above. Namely, as long as a plurality of resin structural members are assembled to form a plurality of prefabricated house units each having formed therein a living space, these prefabricated house units are connected via connecting portions and the internal living spaces are made to communicate with each other via the connecting portions, prefabricated house units may be connected in any manner. The connecting portions may be formed by using structural members similar to those used to form an assembled peripheral wall or an assembled roof, as well.

Industrial Applicability

While an explanation is given above in reference to examples in which the preassembled resin house assumes a cylindrical shape, a semispherical shape and a substantially parallelepiped shape, the present invention may be adopted in the construction of temporary housing, makeshift housing, holiday accommodations and regular residential homes assuming shapes other than those described above.

The disclosure of the following priority application is herein incorporated by reference:

Japanese Patent Application No. 2002-198358

The invention claimed is:

1. A prefabricated resin house, comprising:

a peripheral wall formed by assembling a plurality of peripheral wall structural members comprising styrene foam; and a roof formed by assembling a plurality of roof structural members comprising styrene foam, which is placed on top of the peripheral wall, wherein:

interlocking portions are formed at side end surfaces on both sides of each of the peripheral wall structural members and the peripheral wall structural members are bonded to each other by fitting interlocking portions facing opposite each other;

interlocking portions are formed at side end surfaces on both sides of each of the roof structural members and the roof structural members are bonded to each other by fitting interlocking portions facing opposite each other;

at least a part of the plurality of peripheral wall structural members and the plurality of roof structural members is integrally formed with a rib projecting inside the prefabricated resin house to achieve a ribbed structure; and a part of the rib near an area, where one of the plurality of peripheral wall structural members and one of the plurality of roof structural members are interlocked with each other, projects inside the prefabricated resin house by a greater extent than another part of the rib.

2. A prefabricated resin house comprising:

a peripheral wall formed by assembling a plurality of peripheral wall structural members comprising styrene foam; and a roof formed by assembling a plurality of roof structural members comprising styrene foam, which is placed on top of the peripheral wall, wherein:

peripheral wall interlocking portions are formed at side end surfaces on both sides of each of the peripheral wall structural members and the peripheral wall structural members are bonded to each other by fitting peripheral wall interlocking portions facing opposite each other;

roof interlocking portions are formed at side end surfaces on both sides of each of the roof structural members and the roof structural members are bonded to each other by fitting roof interlocking portions facing opposite each other;

the peripheral wall interlocking portions of two of the peripheral wall structural members fitting to each other and the roof interlocking portions of two of the roof structural members fitting to each other are integrally formed with a rib projecting inside the prefabricated resin house to achieve a ribbed structure;

the two peripheral wall structural members are bonded to each other with an adhesive with a larger bonding area of the peripheral wall interlocking portions of the two peripheral wall structural members in which the ribbed structure is achieved, than a bonding area of peripheral wall interlocking portions in which the ribbed structure is not achieved; and the two roof structural members are bonded to each other with an adhesive with a larger bonding area of the roof interlocking portions of the two roof structural members in which the ribbed structure is achieved, than a bonding area of roof interlocking portions in which the ribbed structure is not achieved.

3. A prefabricated resin house according to claim 1, wherein:

each of the interlocking portions of each of the peripheral wall structural members is formed with a slit-like recessed portion; and the peripheral wall structural members are bonded to each other via a flat plate by inserting the flat plate into the slit-like recessed portion of each of the interlocking portions facing each other.

4. A prefabricated resin house, comprising:

a peripheral wall formed by assembling a plurality of peripheral wall structural members comprising styrene foam; and a roof formed by assembling a plurality of roof structural members comprising styrene foam, which is placed on top of the peripheral wall, wherein:

interlocking portions are formed at side end surfaces on both sides of each of the peripheral wall structural members and the peripheral wall structural members are bonded to each other by fitting interlocking portions facing opposite each other;

interlocking portions are formed at side end surfaces on both sides of each of the roof structural members and the roof structural members are bonded to each other by fitting interlocking portions facing opposite each other;

at least a part of the plurality of peripheral wall structural members and the plurality of roof structural members is integrally formed with a rib projecting inside the prefabricated resin house to achieve a ribbed structure; and two ribs at the plurality of roof structural members are disposed so as to cross each other at a ceiling of the roof.

5. A prefabricated resin house according to claim 2, wherein:

a part of the rib near an area, where one of the plurality of peripheral wall structural members and one of the plurality of roof structural members are interlocked with each other, projects inside the prefabricated resin house by a greater extent than another part of the rib.

6. A prefabricated resin house according to claim 4, wherein:

a part of the rib near an area, where one of the plurality of peripheral wall structural members and one of the plurality of roof structural members are interlocked with each other, projects inside the prefabricated resin house by a greater extent than another part of the rib.

* * * * *